US011833837B2

(12) United States Patent
Ozaki

(10) Patent No.: US 11,833,837 B2
(45) Date of Patent: Dec. 5, 2023

(54) CONTROL DEVICE OF INK CIRCULATION DEVICE, CONTROL METHOD OF INK CIRCULATION DEVICE, PROGRAM, AND PRINTING DEVICE

(71) Applicant: FUJIFILM Corporation, Tokyo (JP)

(72) Inventor: Yuichi Ozaki, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 7 days.

(21) Appl. No.: 17/812,161

(22) Filed: Jul. 12, 2022

(65) Prior Publication Data

US 2023/0036673 A1 Feb. 2, 2023

(30) Foreign Application Priority Data

Jul. 30, 2021 (JP) ..... 2021-125277

(51) Int. Cl.
*B41J 2/18* (2006.01)
*B41J 2/175* (2006.01)

(52) U.S. Cl.
CPC ..... *B41J 2/18* (2013.01); *B41J 2/17596* (2013.01)

(58) Field of Classification Search
CPC . B41J 2/18; B41J 2/17596; B41J 29/38; B41J 2/175
See application file for complete search history.

(56) References Cited

U.S. PATENT DOCUMENTS 10,792,930 B2 * 10/2020 Yamada ..... B41J 2/14024
2010/0073437 A1 3/2010 Shibata et al.
2012/0007902 A1 1/2012 Hiratsuka et al.
2013/0208038 A1 8/2013 Isozaki et al.
2019/0224984 A1 * 7/2019 Kodera ..... B41J 2/1707

FOREIGN PATENT DOCUMENTS

EP 2 628 597 A2 8/2013
EP 3 461 643 A1 4/2019
JP 2013-071247 A 4/2013
JP 2013-166308 A 8/2013

OTHER PUBLICATIONS

The extended European search report issued by the European Patent Office dated Dec. 15, 2022, which corresponds to European Patent Application No. 22182757.9-1014 and is related to U.S. Appl. No. 17/812,161.

* cited by examiner

*Primary Examiner* — An H Do
(74) *Attorney, Agent, or Firm* — Studebaker & Brackett PC

(57) ABSTRACT

Provided are a control device of an ink circulation device, a control method of an ink circulation device, a program, and a printing device that suppress a pressure fluctuation of an ink circulating in an ink jet head regardless of an operation state.

Parameters of a PID control of an upstream side pump that supplies an ink stored in an ink tank to an ink jet head are switched between a jetting state in which the ink is jetted from the ink jet head and a non-jetting state different from the jetting state, and in a case in which, in the upstream side pump in the non-jetting state, proportional gain is denoted by Kp1_in, integral gain is denoted by Ki1_in, and differential gain is denoted by Kd1_in, and, in the upstream side pump in the jetting state, proportional gain is denoted by Kp2_in, integral gain is denoted by Ki2_in, and differential gain is denoted by Kd2_in, relationships of Kp1_in <Kp2_in, Ki1_in>Ki2_in, and Kd1_in<Kd2_in are satisfied.

11 Claims, 14 Drawing Sheets

CONTROL DEVICE OF INK CIRCULATION DEVICE, CONTROL METHOD OF INK CIRCULATION DEVICE, PROGRAM, AND PRINTING DEVICE

CROSS-REFERENCE TO RELATED APPLICATION

The present application claims priority under 35 U.S.C § 119(a) to Japanese Patent Application No. 2021-125277 filed on Jul. 30, 2021, which is hereby expressly incorporated by reference, in its entirety, into the present application.

BACKGROUND OF THE INVENTION

1. Field of the Invention

The present invention relates to a control device of an ink circulation device, a control method of an ink circulation device, a program, and a printing device, and more particularly to the technology of controlling a pressure of an ink circulating in an ink jet head.

2. Description of the Related Art

In a case of an ink jet printing device using ink in which drying or sedimentation easily occurs, the technology of improving drying or sedimentation by circulating the ink in the ink jet head is known.

As means for circulating the ink in the ink jet head, a method is known in which a PID control is performed on the pressure of the ink on a supply side (upstream side) and a recovery side (downstream side) of the ink jet head by a supply side pump and a recovery side pump, respectively (see JP2013-71247A and JP2013-166308A).

SUMMARY OF THE INVENTION

In the ink jet printing device, in a pressure fluctuation of the ink during non-printing, that is, the disturbance of the PID control, the pulsation of the pump is dominant, the amplitude is small, and the frequency is low. On the other hand, in the disturbance of the PID control during printing, the jetting from the ink jet head is dominant, the amplitude of the disturbance of the PID control is large, and the frequency is high.

In this way, in a case in which there is only one set of parameters of the PID control for a control target system of which control characteristics are switched in accordance with a plurality of operation states of the ink jet head, there is a problem that the pressure fluctuations in the plurality of operation states cannot be suppressed, and the pressure fluctuation in any of the states is increased or the all the pressure fluctuations can be suppressed only halfway. For example, with only the parameters of the PID control that suppress the pressure fluctuation during non-printing, there is a problem that the pressure fluctuation during printing cannot be appropriately suppressed, and a dot diameter fluctuates in a case in which printing is performed during the pressure fluctuation of the ink, so that an image quality deteriorates.

The present invention has been made in view of such circumstances, and is to provide a control device of an ink circulation device, a control method of an ink circulation device, a program, and a printing device that suppress a pressure fluctuation of an ink circulating in an ink jet head regardless of an operation state.

An aspect of the present invention for achieving the object described above relates to a control device of an ink circulation device including an upstream side flow passage that circulates an ink from an ink tank that stores the ink to an ink jet head that jets the ink, an upstream side pump that is provided in the upstream side flow passage and supplies the ink stored in the ink tank to the ink jet head, an upstream side pressure sensor that measures a pressure in the upstream side flow passage, a downstream side flow passage that circulates the ink from the ink tank to the ink jet head, a downstream side pump that is provided in the downstream side flow passage and recovers the ink supplied to the ink jet head into the ink tank, and a downstream side pressure sensor that measures a pressure in the downstream side flow passage, the control device comprising at least one processor, and at least one memory that stores a command to be executed by the at least one processor, in which the at least one processor circulates the ink to the ink jet head by applying a pressure difference between an upstream side and a downstream side of the ink jet head by the upstream side pump and the downstream side pump, performs a proportional-integral-differential (PID) control on the upstream side pump and the downstream side pump such that each of a measurement value of the upstream side pressure sensor and a measurement value of the downstream side pressure sensor becomes a target value, and switches parameters of the PID control between a jetting state in which the ink is jetted from the ink jet head and a non-jetting state different from the jetting state, in a case in which, in the upstream side pump in the non-jetting state, proportional gain is denoted by Kp1_in, integral gain is denoted by Ki1_in, and differential gain is denoted by Kd1_in, and, in the upstream side pump in the jetting state, proportional gain is denoted by Kp2_in, integral gain is denoted by Ki2_in, and differential gain of is denoted by Kd2_in, the parameters of the PID control have relationships of Kp1_in<Kp2_in, Ki1_in>Ki2_in, and Kd1_in<Kd2_in, and in a case in which, in the downstream side pump in the non-jetting state, proportional gain is denoted by Kp1_out, integral gain is denoted by Ki1_out, and differential gain is denoted by Kd1_out, and, in the downstream side pump in the jetting state, proportional gain is denoted by Kp2_out, integral gain is denoted by Ki2_out, and differential gain is denoted by Kd2_out, the parameters of the PID control have relationships of Kp1_out<Kp2_out, Ki1_out>Ki2_out, and Kd1_out<Kd2_out. According to the present aspect, the pressure fluctuation of the ink circulating in the ink jet head can be suppressed regardless of the operation state.

It is preferable that the at least one processor acquire a first difference between a flow rate of the ink in the upstream side flow passage and a flow rate of the ink in the downstream side flow passage, determine a case in which the first difference is larger than a predetermined threshold value as the jetting state, and determine a case in which the first difference is equal to or smaller than the threshold value as the non-jetting state. As a result, it is possible to make the determination between the jetting state and the non-jetting state.

It is preferable that the at least one processor acquire a jetting amount of the ink jet head from the first difference, and continuously change the parameters of the PID control with respect to the acquired jetting amount. As a result, the pressure fluctuation of the ink can be continuously suppressed in the jetting state.

It is preferable that, in a case in which the jetting amount is denoted by Qjet, reference proportional gain of the upstream side pump in the jetting state is denoted by Kp0_in, factor of proportionality of the proportional gain of the upstream side pump in the jetting state is denoted by Ap_in, reference integral gain of the upstream side pump in the jetting state is denoted by Ki0_in, factor of proportionality of the integral gain of the upstream side pump in the jetting state is denoted by Ai_in, reference differential gain of the upstream side pump in the jetting state is denoted by Kd0_in, and factor of proportionality of the differential gain of the upstream side pump in the jetting state is denoted by Ad_in, the parameters of the PID control have relationships of Kp2_in=Kp0_in+Ap_in×Qjet, Ki2_in=Ki0_in−Ai_in×Qjet, and Kd2_in=Kd0_in+Ad_in×Qjet, and in a case in which, in the downstream side pump in the jetting state, reference proportional gain is denoted by Kp0_out, factor of proportionality of the proportional gain is denoted by Ap_out, reference integral gain is denoted by Ki0_out, factor of proportionality of the integral gain is denoted by Ai_out, reference differential gain is denoted by Kd0_out, and factor of proportionality of the differential gain is denoted by Ad_out, the parameters of the PID control have relationships of Kp2_out=Kp0_out+Ap_out×Qjet, Ki2_out=Ki0_out−Ai_out×Qjet, and Kd2_out=Kd0_out+Ad_out×Qjet. As a result, the pressure fluctuation of the ink can be continuously suppressed in the jetting state.

It is preferable that the at least one processor acquire the first difference of the upstream side flow passage from a speed of the upstream side pump and a speed of the downstream side pump. As a result, it is possible to appropriately make the determination between the jetting state and the non-jetting state.

It is preferable that the ink circulation device further include an upstream side flowmeter that measures the flow rate of the ink in the upstream side flow passage, and a downstream side flowmeter that measures the flow rate of the ink in the downstream side flow passage, and the at least one processor acquire the first difference from a measurement value of the upstream side flowmeter and a measurement value of the downstream side flowmeter. As a result, it is possible to appropriately make the determination between the jetting state and the non-jetting state.

It is preferable that the parameters of the PID control have relationships of Kp1_in=Kp1_out, Ki1_in=Ki1_out, Kd1_in=Kd1_out, Kp2_in=Kp2_out, Ki2_in=Ki2_out, and Kd2_in=Kd2_out.

Another aspect of the present invention for achieving the object described above relates to a printing device comprising an ink circulation device including an upstream side flow passage that circulates an ink from an ink tank that stores the ink to an ink jet head that jets the ink, an upstream side pump that is provided in the upstream side flow passage and supplies the ink stored in the ink tank to the ink jet head, an upstream side pressure sensor that measures a pressure in the upstream side flow passage, a downstream side flow passage that circulates the ink from the ink tank to the ink jet head, a downstream side pump that is provided in the downstream side flow passage and recovers the ink supplied to the ink jet head into the ink tank, and a downstream side pressure sensor that measures a pressure in the downstream side flow passage, the control device of an ink circulation device described above, the ink tank that stores the ink, the ink jet head that jets the ink, and a moving mechanism that relatively moves a recording medium and the ink jet head, in which the at least one processor jets the ink from the ink jet head to perform printing on the recording medium. According to the present aspect, the pressure fluctuation of the ink circulating in the ink jet head can be suppressed regardless of the operation state.

It is preferable that the at least one processor determine a case in which the printing is performed as the jetting state, and determine a case in which the printing is not performed as the non-jetting state.

Still another aspect of the present invention for achieving the object described above relates to a control method of an ink circulation device including an upstream side flow passage that circulates an ink from an ink tank that stores the ink to an ink jet head that jets the ink, a downstream side flow passage that circulates the ink from the ink tank to the ink jet head, a pump that is provided in the upstream side flow passage or the downstream side flow passage, supplies the ink from the ink tank to the ink jet head through the upstream side flow passage, and recovers the ink supplied to the ink jet head into the ink tank through the downstream side flow passage, and a pressure sensor that measures a pressure in the upstream side flow passage or the downstream side flow passage, the control method comprising a circulation step of circulating the ink to the ink jet head by applying a pressure difference between an upstream side and a downstream side of the ink jet head by the pump, a proportional-integral-differential (PID) control step of performing a PID control on the pump such that a measurement value of pressure sensor becomes a target value, and a switch step of switching parameters of the PID control between a jetting state in which the ink is jetted from the ink jet head and a non-jetting state different from the jetting state, in which, in a case in which, in the pump in the non-jetting state, proportional gain is denoted by Kp1, integral gain is denoted by Ki1, and differential gain is denoted by Kd1, and, in the pump in the jetting state, proportional gain is denoted by Kp2, integral gain is denoted by Ki2, and differential gain is denoted by Kd2, the parameters of the PID control have relationships of Kp1<Kp2, Ki1>Ki2, and Kd1<Kd2. According to the present aspect, the pressure fluctuation of the ink circulating in the ink jet head can be suppressed regardless of the operation state.

Still another aspect of the present invention for achieving the object described above relates to a program causing a computer to execute the control method of an ink circulation device described above. A computer-readable non-transitory storage medium on which the program is recorded may also be included in the present aspect.

According to the present invention, the pressure fluctuation of the ink circulating in the ink jet head can be suppressed regardless of the operation state.

DESCRIPTION OF THE PREFERRED EMBODIMENTS

In the following, a preferred embodiment of the present invention will be described in detail with reference to the accompanying drawings.

Overall Configuration of Ink Circulation Device

Figure 1:
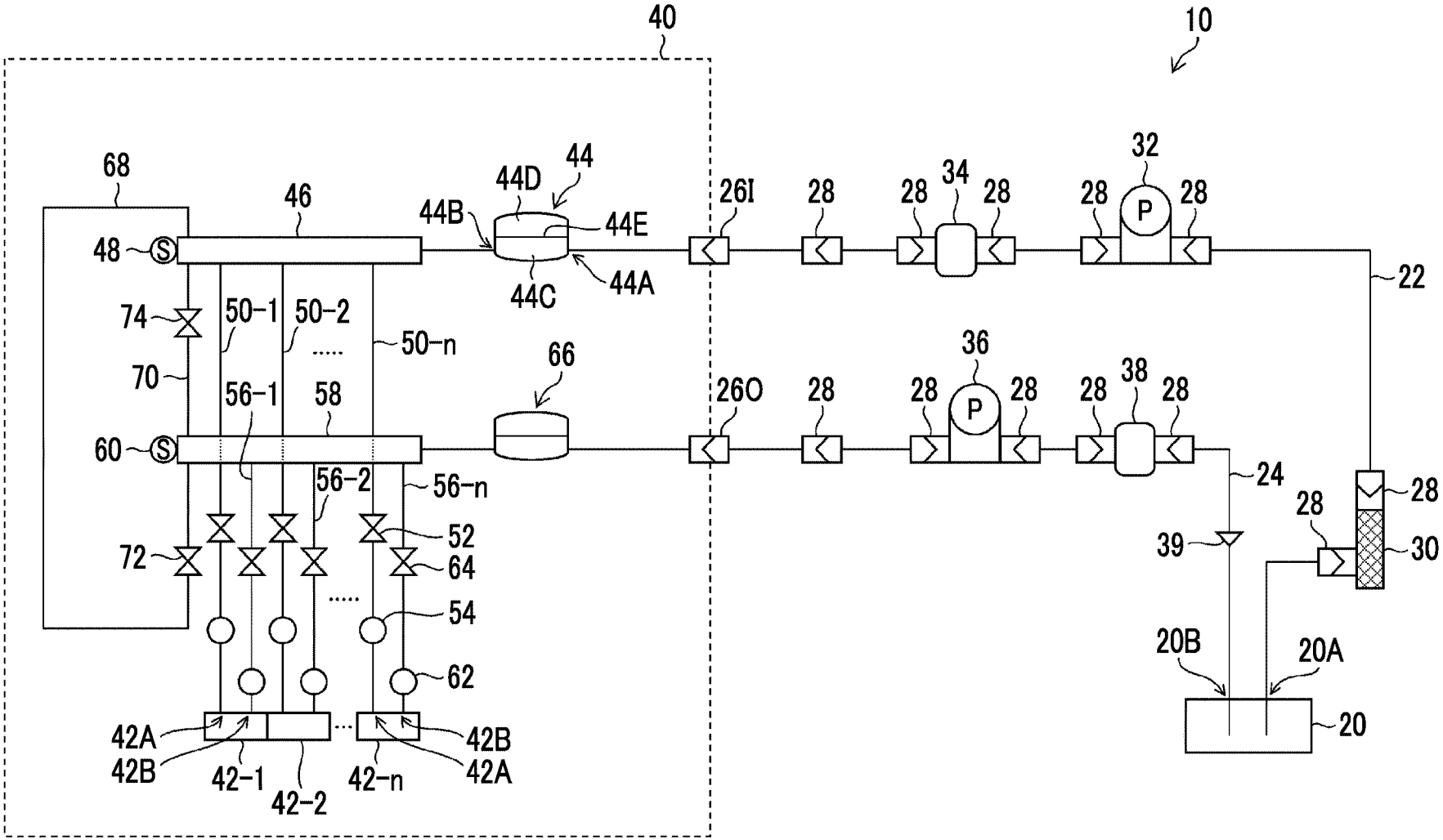
FIG. 1 is an overall configuration diagram of an ink circulation device.

FIG. 1 is an overall configuration diagram of an ink circulation device 10 according to the present embodiment. The ink circulation device 10 is a device that circulates an ink in an ink jet head 40. As shown in FIG. 1, the ink circulation device 10 comprises an ink tank 20, a supply flow passage 22, a recovery flow passage 24, a joint 26I, and a joint 26O.

The ink tank 20 stores the ink circulating in the ink jet head 40.

The ink tank 20 comprises a supply port 20A and a recovery port 20B. The supply port 20A is connected to the supply flow passage 22, and the recovery port 20B is connected to the recovery flow passage 24.

The supply flow passage 22 (an example of an upstream side flow passage) circulates the ink from the ink tank 20 to the ink jet head 40. The recovery flow passage 24 (an example of a downstream side flow passage) circulates the ink from the ink tank 20 to the ink jet head 40.

The supply flow passage 22 and the recovery flow passage 24 include a flow passage constituent member, such as a tube. The supply flow passage 22 communicates the ink tank 20 with the ink jet head 40 through the joint 26I. The recovery flow passage 24 communicates the ink jet head 40 with the ink tank 20 through the joint 26O.

Each of a degassing module 30, a supply pump 32, and a supply side filter 34 is connected to the supply flow passage 22 by a joint 28.

The degassing module 30 performs degassing processing on the ink passing through the supply flow passage 22. The supply pump 32 (an example of an upstream side pump) applies a pressure to the ink inside the supply flow passage 22 to generate a flow of the ink inside the supply flow passage 22, and supplies the ink stored in the ink tank 20 to the ink jet head 40. As the supply pump 32, for example, a tube pump can be applied. The supply side filter 34 removes air bubbles, foreign substances, and the like contained in the ink.

Each of a recovery pump 36 and a recovery side filter 38 is connected to the recovery flow passage 24 by the joint 28.

The recovery pump 36 (an example of a downstream side pump) applies a pressure to the ink inside the recovery flow passage 24 to generate a flow of the ink inside the recovery flow passage 24, and recovers the ink supplied to the ink jet head 40 into the ink tank 20. As the recovery pump 36, for example, the tube pump can be applied. The recovery side filter 38 removes air bubbles and foreign substances contained in the ink.

In addition, a one-way valve 39 is connected to the recovery flow passage 24. The one-way valve 39 allows only the flow of the ink from the ink jet head 40 side to the ink tank 20 side, and regulates the flow of the ink from the ink tank 20 side to the ink jet head 40 side.

With the ink circulation device 10 configured in this way, the ink is circulating in the ink jet head 40 by applying a pressure difference between an upstream side and a downstream side of the ink jet head 40. That is, the ink stored in the ink tank 20 is supplied to the ink jet head 40 through the supply flow passage 22. In addition, the ink that is not used in the ink jet head 40 is recovered into the ink tank 20 through the recovery flow passage 24. As a result, the ink can be stably supplied from the ink tank 20 to the ink jet head 40 in accordance with the ink consumption of the ink jet head 40.

Flow Passage Configuration of Ink Jet Head

The ink jet head 40 comprises a plurality of nozzles 202 (FIG. 5), and is a liquid jetting head that jets the ink from the plurality of nozzles 202. As shown in FIG. 1, the ink jet head 40 comprises a head module 42, a supply side back pressure tank 44, a supply side head manifold 46, a supply side pressure sensor 48, an ink supply flow passage 50, an ink recovery flow passage 56, a recovery side head manifold 58, a recovery side pressure sensor 60, and a recovery side back pressure tank 66.

The ink jet head 40 is a line-type ink jet head having a structure in which a plurality of head modules 42 are connected to each other. In the example shown in FIG. 1, the ink jet head 40 comprises n head modules 42 of head modules 42-1, 42-2, . . . , and **42-*n*. It should be noted that the ink jet head 40 may be composed of only one head module 42**.

The supply side back pressure tank 44 is a pressure buffer device that suppresses internal pressure fluctuations of the supply flow passage 22 and the supply side head manifold 46. The supply side back pressure tank 44 comprises an ink inlet 44A, an ink outlet 44B, a liquid chamber 44C, an air chamber 44D, and an elastic membrane 44E.

The supply side back pressure tank 44 communicates with the supply flow passage 22 through the ink inlet 44A and the joint 26I. In addition, the supply side back pressure tank 44 communicates with the supply side head manifold 46 through the ink outlet 44B. The ink flowing into from the ink inlet 44A flows out from the ink outlet 44B through the liquid chamber 44C.

Air is sealed in the air chamber 44D. The elastic membrane 44E is disposed between the liquid chamber 44C and the air chamber 44D to separate the liquid chamber 44C and the air chamber 44D. The elastic membrane 44E is deformed in accordance with the pressure fluctuation of the ink passing through the liquid chamber 44C to reduce the pressure fluctuation of the ink passing through the liquid chamber 44C.

The ink flowing out from the ink outlet 44B flows into the supply side head manifold 46. The supply side head manifold 46 is provided with the supply side pressure sensor 48. The supply side pressure sensor 48 detects the internal pressure of the supply side head manifold 46.

As the supply side pressure sensor 48, a sensor, such as a semiconductor piezo resistance type, a capacitance type, or a silicon resonant type, can be used. Here, the supply side pressure sensor 48 is provided in the ink jet head 40, but may be provided in the supply flow passage 22 outside the ink jet head 40.

The head modules 42-1, 42-2, . . . , and **42-*n* each comprise an ink supply port 42A and an ink recovery port 42B. The ink jet head 40 comprises ink supply flow passages 50-1, 50-2, . . . , and 50-*n*. The supply side head manifold 46 communicates with the ink supply port 42A of each of the head modules 42-1, 42-2, . . . , and 42-*n* through the ink supply flow passages 50-1, 50-2, . . . , and 50-*n*. The ink flowing into the supply side head manifold 46 flows into the head modules 42-1, 42-2, . . . , and 42-*n* through the ink supply port 42**A.

The ink supply flow passages 50-1, 50-2, . . . , and **50-*n* each comprise a supply valve 52 and a supply damper 54. The supply valve 52 switches the communication and cutoff of each of the ink supply flow passages 50-1, 50-2, . . . , and 50-*n*. The supply damper 54 absorbs the pressure fluctuation of the ink flowing through the ink supply flow passages 50-1, 50-2, . . . , and 50-*n***.

The ink jet head 40 comprises ink recovery flow passages 56-1, 56-2, . . . , and **56-*n*. The recovery side head manifold 58 communicates with the ink recovery port 42B of each of the head modules 42-1, 42-2, . . . , and 42-*n* through the ink recovery flow passages 56-1, 56-2, . . . , and 56-*n***.

The ink flowing into the head modules 42-1, 42-2, . . . , and **42-*n* flows into the recovery side head manifold 58 through the ink recovery flow passages 56-1, 56-2, . . . , and 56-*n*. The recovery side head manifold 58 is provided with a recovery side pressure sensor 60. The recovery side pressure sensor 60 detects the internal pressure of the recovery side head manifold 58**.

As the recovery side pressure sensor 60, similarly to the supply side pressure sensor 48, a sensor, such as a semiconductor piezo resistance type, a capacitance type, or a silicon resonant type, can be used. Here, the recovery side pressure sensor 60 is provided in the ink jet head 40, but may be provided in the recovery flow passage 24 outside the ink jet head 40.

The ink recovery flow passages 56-1, 56-2, . . . , and **56-*n* each comprise a recovery damper 62 and a recovery valve 64. The recovery damper 62 absorbs the pressure fluctuation of the ink flowing through the ink recovery flow passages 56-1, 56-2, . . . , and 56-*n*. The recovery valve 64 switches the communication and cutoff of each of the ink recovery flow passages 56-1, 56-2, . . . , and 56-*n***.

The recovery side back pressure tank 66 is a pressure buffer device that suppresses the internal pressure fluctuations of the recovery side head manifold 58 and the recovery flow passage 24. The configuration of the recovery side back pressure tank 66 is the same as the configuration of the supply side back pressure tank 44. The ink flowing into the recovery side head manifold 58 flows out of the ink jet head 40 through the recovery side back pressure tank 66 and the joint 26O.

In addition, the ink jet head 40 comprises a first bypass flow passage 68 and a second bypass flow passage 70. The first bypass flow passage 68 and the second bypass flow passage 70 communicate with the supply side head manifold 46 and the recovery side head manifold 58, respectively.

The first bypass flow passage 68 is provided with a first bypass flow passage valve 72. The first bypass flow passage valve 72 operates in response to a control signal to switch between opening and closing the first bypass flow passage 68. The second bypass flow passage 70 is provided with a second bypass flow passage valve 74. The second bypass flow passage valve 74 switches the opening and closing of the second bypass flow passage 70 in response to the control signal.

Electric Configuration of Ink Circulation Device

Figure 2:
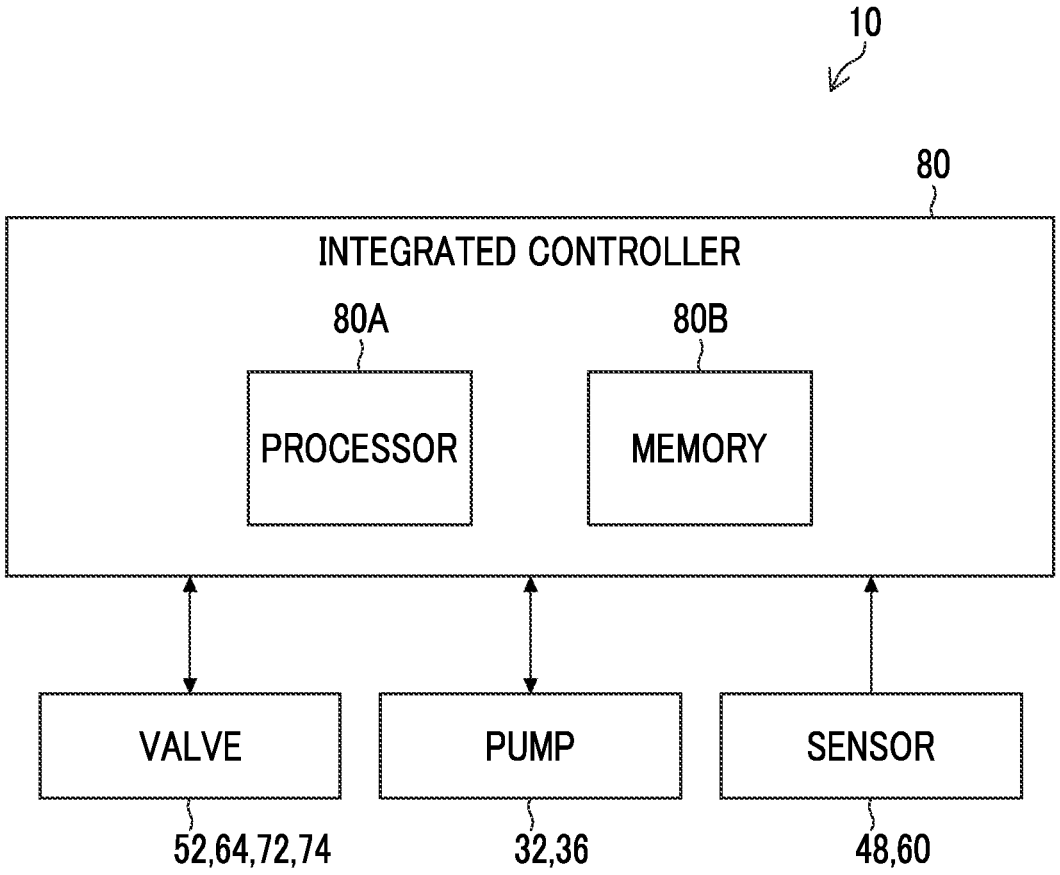
FIG. 2 is a block diagram showing an electric configuration of the ink circulation device.

FIG. 2 is a block diagram showing an electric configuration of the ink circulation device 10. As shown in FIG. 2, the ink circulation device 10 comprises an integrated controller 80.

The integrated controller 80 (an example of a control device of the ink circulation device) controls the operation of the ink circulation device 10 in an integrated manner. The integrated controller 80 comprises a processor 80A and a memory 80B.

The processor 80A executes a command stored in the memory 80B. The hardware structure of the processor 80A is various processors as shown below. Various processors include a central processing unit (CPU) as a general-purpose processor which functions as various function units by executing software (program), a graphics processing unit (GPU) as a processor specialized in image processing, a programmable logic device (PLD) as a processor of which a circuit configuration can be changed after manufacture, such as a field programmable gate array (FPGA), and a dedicated electrical circuit as a processor, which has a circuit configuration specifically designed to execute specific processing, such as an application specific integrated circuit (ASIC).

One processing unit may be composed of one of these various processors, or two or more processors of the same type or different types (for example, a plurality of FPGAs, or a combination of a CPU and an FPGA, or a combination of a CPU and a GPU). In addition, a plurality of function units may be composed of one processor. As a first example in which the plurality of function units are composed of one processor, as represented by a computer such as a client or a server, there is a form in which one processor is composed of a combination of one or more CPUs and software, and this processor operates as the plurality of function units. As a second example thereof, as represented by a system-on-chip (SoC), there is a form in which a processor that realizes the functions of the entire system including the plurality of function units by one integrated circuit (IC) chip is used. As described above, various function units are composed of one or more of the various processors described above as the hardware structure.

Further, the hardware structures of these various processors are, more specifically, an electric circuit (circuitry) in which circuit elements, such as semiconductor elements, are combined.

The memory 80B stores the command executed by the processor 80A. The memory 80B includes a random access memory (RAM) and a read only memory (ROM) (not shown). The processor 80A uses the RAM as a work region, executes software using various programs and parameters including a control program of the ink circulation device stored in the ROM, and uses the parameters stored in the ROM or the like to execute various pieces of processing of the ink circulation device 10.

The integrated controller 80 controls the opening and closing of the supply valve 52, the recovery valve 64, the first bypass flow passage valve 72, and the second bypass flow passage valve 74, and defines the flow passage through which the ink passes.

In addition, the integrated controller 80 controls the operations of the supply pump 32 and the recovery pump 36, and defines a flow rate of the ink flowing through the supply flow passage 22 and the recovery flow passage 24. The integrated controller 80 performs a feedback control on the supply pump 32 and the recovery pump 36 such that each of a measurement value of the supply side pressure sensor 48 and a measurement value of the recovery side pressure sensor 60 becomes a target pressure value, and defines the flow rate of the ink flowing through the supply flow passage 22 and the recovery flow passage 24.

Ink Circulation Control

Figure 3:
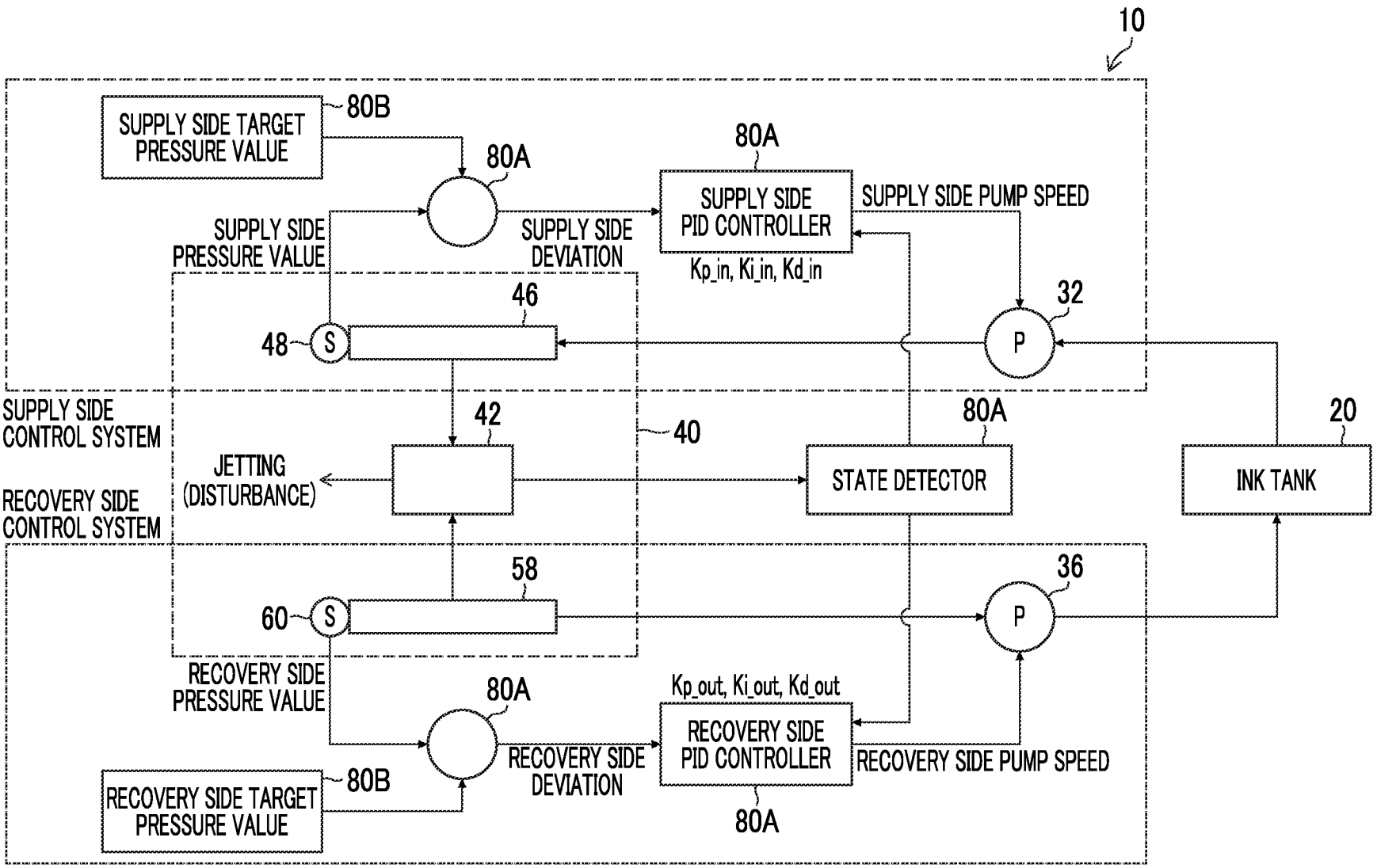
FIG. 3 is a diagram showing a control of an ink circulation system in the ink circulation device.

A control method of the ink circulation device 10 will be described. The ink circulation device 10 suppresses the ink pressure fluctuation due to disturbance, such as ink jetting from the ink jet head 40 (head module 42). FIG. 3 is a diagram showing a control of an ink circulation system in the ink circulation device 10. As shown in FIG. 3, the control of the ink circulation system is divided into a supply side control system and a recovery side control system.

First, the supply side control system will be described. The processor 80A, which functions as a supply side PID controller, operates the supply pump 32 at a supply side pump speed of a predetermined initial value, and supplies the ink stored in the ink tank 20 to the head module 42 through the supply side head manifold 46 (an example of a circulation step).

The processor 80A functioning as a subtractor acquires a supply side target pressure value stored in the memory 80B and the measurement value of the supply side pressure sensor 48, and calculates the deviation thereof. In a case in which the supply side target pressure value is denoted by Pt_in and the measurement value of the supply side pressure sensor 48 is denoted by Pm_in(i), a supply side deviation e_in(i), which is a difference between the supply side target pressure value and the measurement value of the supply side pressure sensor 48 can be represented by Expression 1.

$$e_\text{in}(i)=Pt_\text{in}-Pm_\text{in}(i) \quad \text{(Expression 1)}$$

In addition, in a case in which the proportional gain is denoted by Kp_in, the integral gain is denoted by Ki_in, the differential gain is denoted by Kd_in, and a sampling period of the supply side pressure sensor 48 is denoted by Δ_in, which are the parameters of the PID control of the supply pump 32, a flow rate U_in(i) of the ink in the supply flow passage 22 can be represented by Expression 2.

$$U\text{-in}(i)=Kp_\text{in}\times e_\text{in}(i)+Ki_\text{in}\times\Sigma e_\text{in}(i)\times\Delta t_\text{in}+Kd\text{-in}\times(e_\text{in}(i)-e\text{-in}(i-1))/\Delta t_\text{in} \quad \text{(Expression 2)}$$

Therefore, a difference ΔU_in(i) between the flow rates of the ink in the supply flow passage 22 from the previous time and the current time can be represented by Expression 3.

$$\Delta U\text{-in}(i)=Kp\text{-in}\times(e\text{-in}(i)-e\text{-in}(i-1))+Ki_\text{in}\times e_\text{in}(i)\times\Delta t_\text{in}+Kd\text{-in}\times((e_\text{in}(i)-e\text{-in}(i-1))-((e\text{-in}(i-1)-e\text{-in}(e-2)))/\Delta t_\text{in} \quad \text{(Expression 3)}$$

The processor 80A functioning as the supply side PID controller determines the supply side pump speed of the supply pump 32 based on ΔU_in(i) represented by Expression 3, and drives the supply pump 32 at the determined supply side pump speed (an example of a PID control step).

In this way, the integrated controller 80 performs the PID control of the supply pump 32 (an example of the upstream side pump) such that the measurement value of the supply side pressure sensor 48 (an example of the upstream side pressure sensor) becomes the target pressure value (an example of the target value) in the supply side control system.

Then, the recovery side control system will be described. The processor 80A, which functions as a recovery side PID controller, operates the recovery pump 36 at a recovery side pump speed of a predetermined initial value, and recovers the ink supplied to the head module 42 into the ink tank 20 through the recovery side head manifold 58 (an example of the circulation step).

The processor 80A functioning as a subtractor acquires a recovery side target pressure value stored in the memory 80B and the measurement value of the recovery side pressure sensor 60, and calculates the deviation thereof. In a case in which the recovery side target pressure value is denoted by Pt_out and the recovery side pressure sensor 60 measurement value is denoted by Pm_out(i), a recovery side deviation e_out(i), which is a difference between the recovery side target pressure value and the measurement value of the recovery side pressure sensor 60 can be represented by Expression 4.

$$e_\text{out}(i)=Pt_\text{out}-Pm_\text{out}(i) \quad \text{(Expression 4)}$$

In addition, in a case in which the proportional gain is denoted by Kp_out, the integral gain is denoted by Ki_out, the differential gain is denoted by Kd_out, and a sampling period of the recovery side pressure sensor 60 is denoted by Δt_out, which are the parameters of the PID control of the recovery pump 36, a flow rate U_out(i) of the ink in the recovery flow passage 24 can be represented by Expression 5.

$$U_\text{out}(i)=Kp_\text{out}\times e_\text{out}(i)+Ki_\text{out}\times\Sigma e_\text{out}(i)\times\Delta t_\text{out}+Kd_\text{out}\times(e_\text{out}(i)-e_\text{out}(i-1))/\Delta t_\text{out} \quad \text{(Expression 5)}$$

Therefore, a difference ΔU_out(i) between the flow rates of the ink in the recovery flow passage 24 from the previous time and the current time can be represented by Expression 6.

$$\Delta U_\text{out}(i)=Kp_\text{out}\times(e_\text{out}(i)-e_\text{out}(i-1))+Ki_\text{out}\times e_\text{out}(i)\times\Delta t_\text{out}+Kd_\text{out}\times((e_\text{out}(i)-e_\text{out}(i-1))-((e_\text{out}(i-1)-e_\text{out}(i-2)))/\Delta t_\text{out} \quad \text{(Expression 6)}$$

The processor 80A functioning as the recovery side PID controller determines the recovery side pump speed of the recovery pump 36 based on ΔU_out(i) represented by Expression 6, and drives the recovery pump 36 at the determined recovery side pump speed (an example of the PID control step).

In this way, the integrated controller 80 performs the PID control of the recovery pump 36 (an example of the downstream side pump) such that the measurement value of the recovery side pressure sensor 60 (an example of the downstream side pressure sensor) becomes the target pressure value (an example of the target value) in the recovery side control system.

In the present embodiment, the processor 80A switches the parameters of the PID control between a jetting state in which the ink is jetted from the ink jet head 40 (head module 42) and a non-jetting state in which the ink is not jetted from the head module 42 (an example of a switch step).

The processor 80A, which functions as a state detector, determines whether the ink jet head 40 is in the jetting state in which the ink is jetted or the non-jetting state in which the ink is not jetted, in accordance with the relationship between the flow rate Qin of ink in the supply flow passage 22 upstream of the ink jet head 40 and the flow rate Qout of the ink in the recovery flow passage 24 downstream of the ink jet head 40. In a case in which the ink is jetted from the ink jet head 40, Qin is larger than Qout, and the difference between Qin and Qout is increased. Therefore, as shown in Expressions 7 and 8, a case in which the difference between Qin and Qout (an example of a first difference) is equal to or smaller than a threshold value A is determined as the non-jetting state, and a case in which the difference between Qin and Qout is larger than the threshold value A is determined as the jetting state.

Non-jetting state: $Qin-Qout \leq A$ (Expression 7)

Jetting state: $Qin-Qout > A$ (Expression 8)

It should be noted that the flow rate Qin of the ink in the supply flow passage 22 and the flow rate Qout of the ink in the recovery flow passage 24 may be measured by an upstream side flowmeter (not shown) that measures the flow rate of the ink in the supply flow passage 22 and a downstream side flowmeter (not shown) that measures the flow rate of the ink of the recovery flow passage 24, may be calculated from a pressure difference and a flow passage resistance in a certain section, or may be calculated from the pump speed of the supply pump 32 and the pump speed of the recovery pump 36. In addition, U_in(i) obtained by Expression 2 may be used as Qin, or U_out(i) obtained by Expression 5 may be used as Qout.

The processor 80A switches the proportional gain Kp_in, the integral gain Ki_in, and the differential gain Kd_in, which are the parameters of the PID control of the supply pump 32, as shown in Expressions 9 and 10 in accordance with the non-jetting state and the jetting state.

Non-jetting state: $Kp_in=Kp1_in, Ki1_in=Ki1_in, Kd_in=Kd1_in$ (Expression 9)

Jetting state: $Kp_in=Kp2_in, Ki_in=Ki2_in, Kd_in=Kd2_in$ (Expression 10)

Here, the magnitude relationship of the parameters of the PID control is as shown in Expressions 11, 12, and 13.

$Kp1_in<Kp2_in$ (Expression 11)

$Ki1\text{-}in>Ki2_in$ (Expression 12)

$Kd1_in<Kd2_in$ (Expression 13)

In addition, similar to the recovery side control system, the processor 80A switches the proportional gain Kp_out, the integral gain Ki_out, and the differential gain Kd_out, which are the parameters of the PID control of the recovery pump 36, as shown in Expressions 14 and 15 in accordance with the non-jetting state and the jetting state.

Non-jetting state: $Kp_out=Kp1_out, Ki_out=Ki1_out, Kd_out=Kd1_out$ (Expression 14)

Jetting state: $Kp_out=Kp2_out, Ki_out=Ki2_out, Kd_out=Kd2_out$ (Expression 15)

Here, the magnitude relationship of the parameters of the PID control is as shown in Expressions 16, 17, and 18.

$Kp1_out<Kp2_out$ (Expression 16)

$Ki1_out>Ki2_out$ (Expression 17)

$Kd1_out<Kd2_out$ (Expression 18)

By controlling the supply pump 32 and the recovery pump 36 with the parameters of the PID control as described above, the low-frequency pressure fluctuation of the ink circulating in the ink jet head 40 due to the reason other than the jetting operation in the non-jetting state can be suppressed and the high-frequency pressure fluctuation thereof due to the jetting operation in the jetting state can be suppressed, so that the pressure fluctuation can be suppressed regardless of the jetting state and the non-jetting state.

Here, the example has been described in which each of the supply side control system and the recovery side control system is controlled, but at least one of the supply side control system or the recovery side control system need only be controlled.

Printing Device

Figure 4:
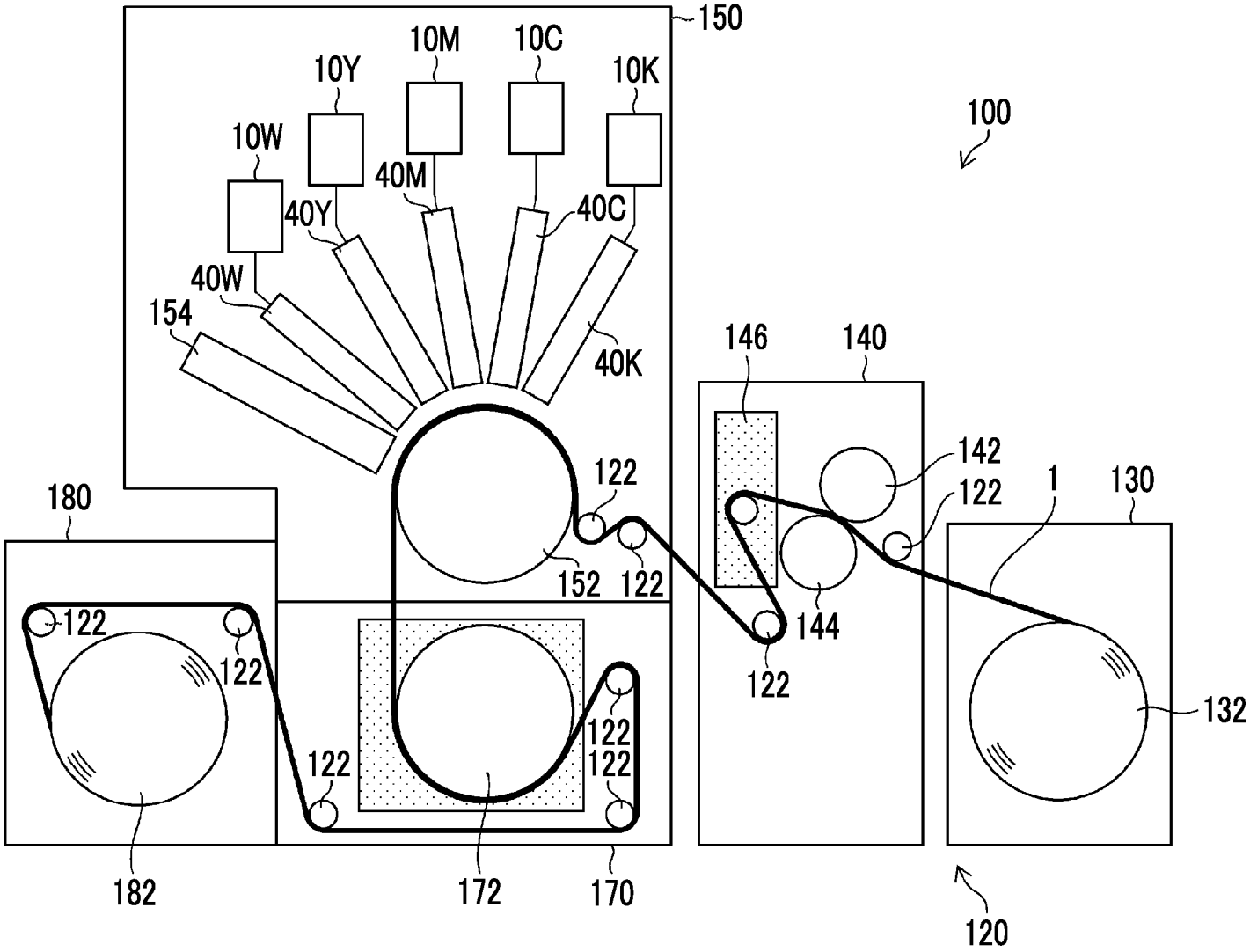
FIG. 4 is an overall configuration diagram of an ink jet printing device including the ink circulation device.

FIG. 4 is an overall configuration diagram of an ink jet printing device 100 including the ink circulation device 10. The ink jet printing device 100 is a printing device that prints an image on web-shaped paper 1 by a single pass method. The paper 1 corresponds to a recording medium, and is, for example, general-purpose printing paper. The general-purpose printing paper is not so-called ink jet-dedicated paper, but paper mainly formed of cellulose, such as coated paper, used for general offset printing and the like.

As shown in FIG. 4, the ink jet printing device 100 comprises a transport device 120, a sending device 130, a pretreatment liquid applying device 140, a printing device 150, a drying device 170, and a winding device 180.

Transport Device

The transport device 120 transports the paper 1 from the sending device 130 to the winding device 180 along a transport path. The transport device 120 corresponds to a moving mechanism that relatively moves the paper 1 and the ink jet head 40.

The transport device 120 comprises a plurality of pass rollers 122. The pass roller 122 functions as a guide roller that supports the paper 1 in the transport path of the paper 1.

The transport device 120 guides the paper 1 unwound from the sending device 130 by the plurality of pass rollers 122, and transports the paper 1 to the sending device 130, the pretreatment liquid applying device 140, the printing device 150, the drying device 170, and the winding device 180 in this order.

It should be noted that, in the following, a traveling direction of the paper 1 along the transport path of the paper 1 from the sending device 130 to the winding device 180 is referred to as a transport direction of the paper 1.

Sending Device

The sending device 130 comprises a sending roll 132. The sending roll 132 comprises a reel (not shown) which is rotatably supported. The paper 1 before the image is printed is rolled around the reel.

Winding Device

The winding device 180 comprises a winding roll 182. The winding roll 182 comprises a reel (not shown) which is rotatably supported. One end of the paper 1 is connected to the reel. The winding roll 182 comprises a winding motor (not shown) that rotationally drives the reel.

Pretreatment Liquid Applying Device

The pretreatment liquid applying device 140 applies a pretreatment liquid to a print surface of the paper 1. The pretreatment liquid is a liquid containing a component that thickens an aqueous ink by aggregating or insolubilizing a coloring material component in the aqueous ink. The pretreatment liquid applying device 140 comprises an applying roller 142, a facing roller 144, and a pretreatment liquid drying device 146. The paper 1 transported from the sending device 130 is guided by the pass roller 122 and transported to a position facing the applying roller 142.

The pretreatment liquid applying device 140 interposes the paper 1 between the applying roller 142 to which the pretreatment liquid is supplied to an outer peripheral surface and the facing roller 144, and applies the pretreatment liquid on the outer peripheral surface of the applying roller 142 to the print surface of the paper 1.

The pretreatment liquid drying device 146 performs drying processing on the paper 1 coated with the pretreatment liquid. The pretreatment liquid drying device 146 blows hot air onto the paper 1 by a hot air heater (not shown).

Printing Device

The printing device 150 prints a color image on the print surface of the paper 1 (an example of printing). The printing device 150 comprises ink jet heads 40K, 40C, 40M, 40Y, and 40W. The ink jet heads 40K, 40C, 40M, 40Y, and 40W jet black, cyan, magenta, yellow, and white aqueous inks, respectively.

As the ink jet heads 40K, 40C, 40M, 40Y, and 40W, the ink jet head 40 shown in FIG. 1 can be used, respectively.

The printing device 150 comprises ink circulation devices 10K, 10C, 10M, 10Y, and 10W. As the ink circulation devices 10K, 10C, 10M, 10Y, and 10W, the ink circulation device 10 shown in FIG. 1 can be used, respectively. The ink circulation devices 10K, 10C, 10M, 10Y, and 10W circulate the aqueous ink of corresponding colors inside the ink jet heads 40K, 40C, 40M, 40Y, and 40W, respectively.

It should be noted that the aqueous ink includes an ink in which pigment particles are dispersed in a solvent, such as water.

In addition, the printing device 150 comprises a printing drum 152 and a scanner 154. The printing drum 152 comprises a suction hole (not shown) on the outer peripheral surface. The printing drum 152 sucks the paper 1 from the inside through the suction hole, sucks the paper 1 on the outer peripheral surface, and rotates the paper 1 to transport the paper 1.

The ink jet heads 40K, 40C, 40M, 40Y, and 40W print the color image on the print surface of the paper 1 by jetting the aqueous ink of each color on the paper 1 transported directly under the printing drum 152.

The scanner 154 comprises an imaging device that captures an image, such as a test image, printed on the print surface of the paper 1 and generates an imaging signal corresponding to the image. As the imaging device, it is possible to use a color charge coupled device (CCD) linear image sensor, a color complementary metal oxide semiconductor (CMOS) linear image sensor, or the like.

Drying Device

The drying device 170 comprises a drying drum 172. The drying drum 172 comprises a suction hole (not shown) on the outer peripheral surface. The drying drum 172 sucks the paper 1 from the inside through the suction hole, sucks the paper 1 on the outer peripheral surface, and rotates the paper 1 to transport the paper 1. The drying device 170 blows hot air from the hot air heater (not shown) onto the print surface of the paper 1 transported by the drying drum 172 to dry the print surface of the paper 1.

Configurations of Ink Jet Head and Head Module

The ink jet head 40 has a structure in which the plurality of head modules 42 are connected together in a width direction of the paper 1. The plurality of head modules 42 have the same structure. It should be noted that the width direction of the paper 1 is a direction orthogonal to the transport direction of the paper 1.

Figure 5:
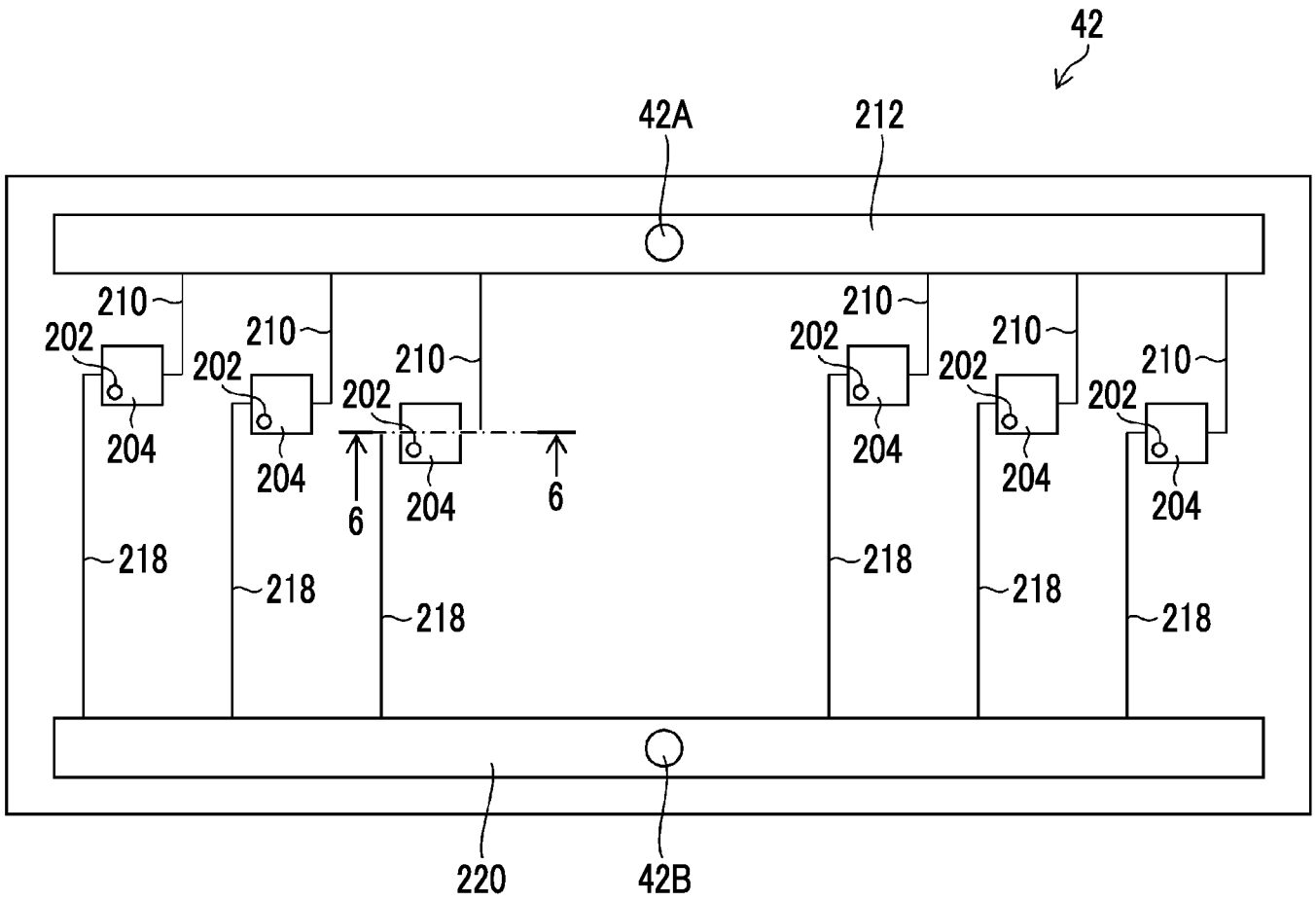
FIG. 5 is a plan perspective view showing a structure example of a head module.

FIG. 5 is a plan perspective view showing a structure example of the head module 42. A reference numeral X shown in FIG. 5 represents the width direction of the paper 1, and a reference numeral Y represents the transport direction of the paper 1. In addition, a reference numeral Z represents a normal direction of the outer peripheral surface of the printing drum 152, which is the same as a direction parallel to a direction in which the nozzle surface 200 (see FIG. 6) of the head module 42 faces.

As shown in FIG. 5, the head module 42 comprises the plurality of nozzles 202. The plurality of nozzles 202 are two-dimensionally arranged. It should be noted that the arrangement of the nozzles 202 is not limited to the two-dimensional shape.

The plurality of nozzles 202 each communicate with the pressure chamber 204. The pressure chamber 204 communicates with a supply tributary 210. The supply tributary 210 communicates with a common flow passage 212. The common flow passage 212 communicates with the ink supply port 42A.

Figure 6:
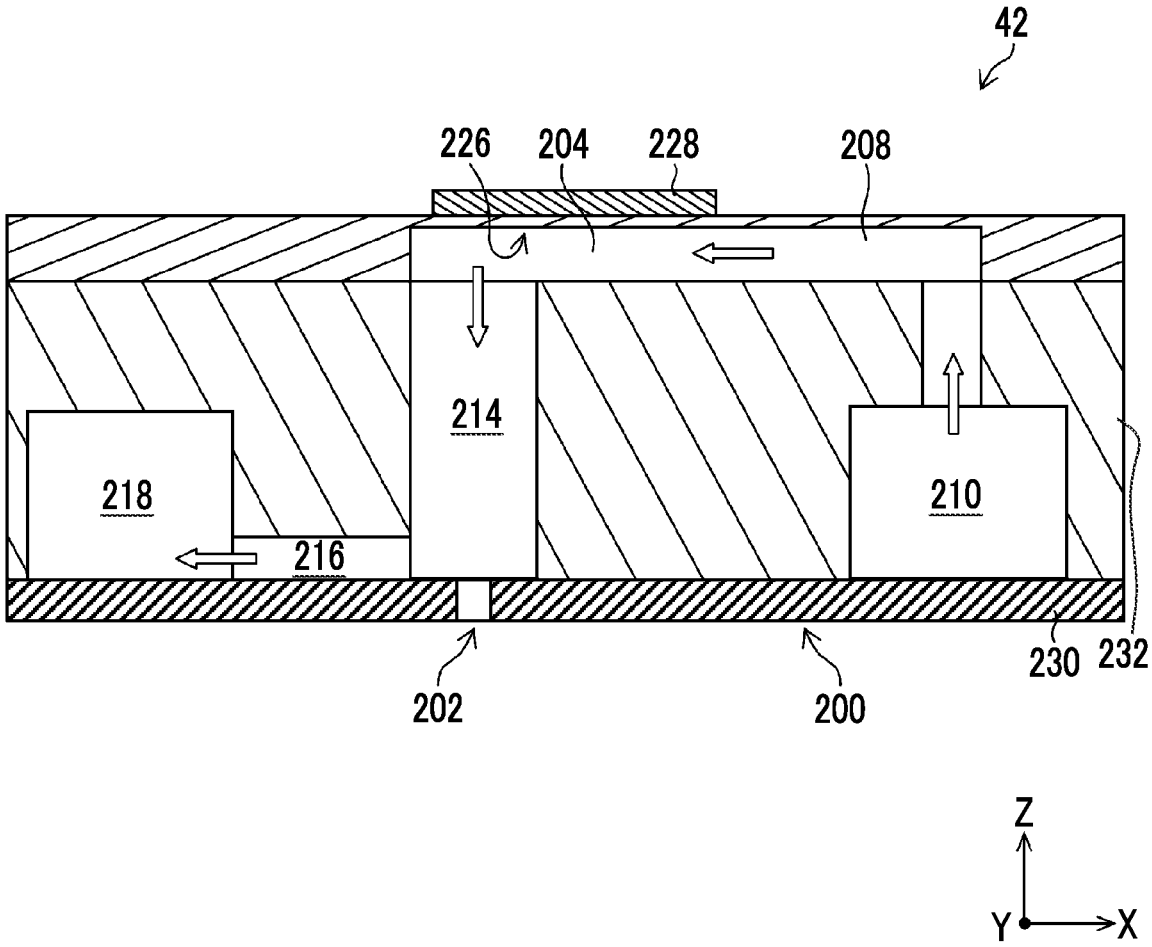
FIG. 6 is a cross-sectional view taken along line 6-6 of FIG. 5.

In addition, each nozzle 202 communicates with a recovery tributary 218 through an ink circulation passage 216 (see FIG. 6). The recovery tributary 218 communicates with a circulation common flow passage 220. The circulation common flow passage 220 communicates with the ink recovery port 42B.

FIG. 6 is a cross-sectional view taken along line 6-6 of FIG. 5. As shown in FIG. 6, the head module 42 comprises a nozzle plate 230, a flow passage plate 232, and an actuator 228. The head module 42 has a structure in which the nozzle plate 230, the flow passage plate 232, and the actuator 228 are laminated in this order.

The plurality of nozzles 202 are formed in the nozzle plate 230. The nozzle 202 has an opening formed in the nozzle surface 200 and has a structure penetrating the nozzle plate 230.

In the flow passage plate 232, the pressure chamber 204, a supply throttle 208, the supply tributary 210, the common flow passage 212 (see FIG. 5), a descender 214, the ink circulation passage 216, the recovery tributary 218, and the circulation common flow passage 220 (see FIG. 5) are formed.

The nozzle 202 communicates with the pressure chamber 204 through the descender 214. The pressure chamber 204 communicates with the supply tributary 210 through the supply throttle 208. In addition, the nozzle 202 communicates with the recovery tributary 218 through the ink circulation passage 216.

The ink supplied to the ink supply port 42A flows through the common flow passage 212, the supply tributary 210, the supply throttle 208, the pressure chamber 204, and the descender 214, and a part of the ink is jetted from each nozzle 202. The ink that is not jetted from the nozzle 202 is discharged from the ink recovery port 42B through the ink circulation passage 216, the recovery tributary 218, and the circulation common flow passage 220.

It should be noted that the ink circulation passage 216 is preferably disposed around the nozzle 202. Here, the ink circulation passage 216 is disposed in a region communicating with the descender 214 and in a region in contact with the nozzle plate 230 of the flow passage plate 232. As a result, the ink can circulate in the vicinity of the nozzle 202, the thickening of the ink inside the nozzle 202 is suppressed, and stable jetting of the head module 42 is realized.

The actuator 228 is a top surface of the pressure chamber 204 and is disposed on the vibration plate 226 which is also used as a common electrode. The actuator 228 is a piezoelectric element comprising a piezoelectric layer (not shown) and individual electrodes (not shown).

The actuator 228 is bent and deformed in accordance with the application of a drive voltage to the individual electrodes. The pressure chamber 204 is deformed by the deformation of the actuator 228, and the ink is jetted from the nozzle 202 in accordance with the contraction of the pressure chamber 204. In addition, in accordance with the expansion of the pressure chamber 204 after the ink is jetted from the nozzle 202, a new ink is supplied to the pressure chamber 204 from the common flow passage 212 through the supply tributary 210 and the supply throttle 208.

Here, the piezoelectric method has been described as an example of the jetting method of the ink, but the jetting method of the ink may be a thermal method, an electrostatic method, or the like.

Electric Configuration of Ink Jet Printing Device

Figure 7:
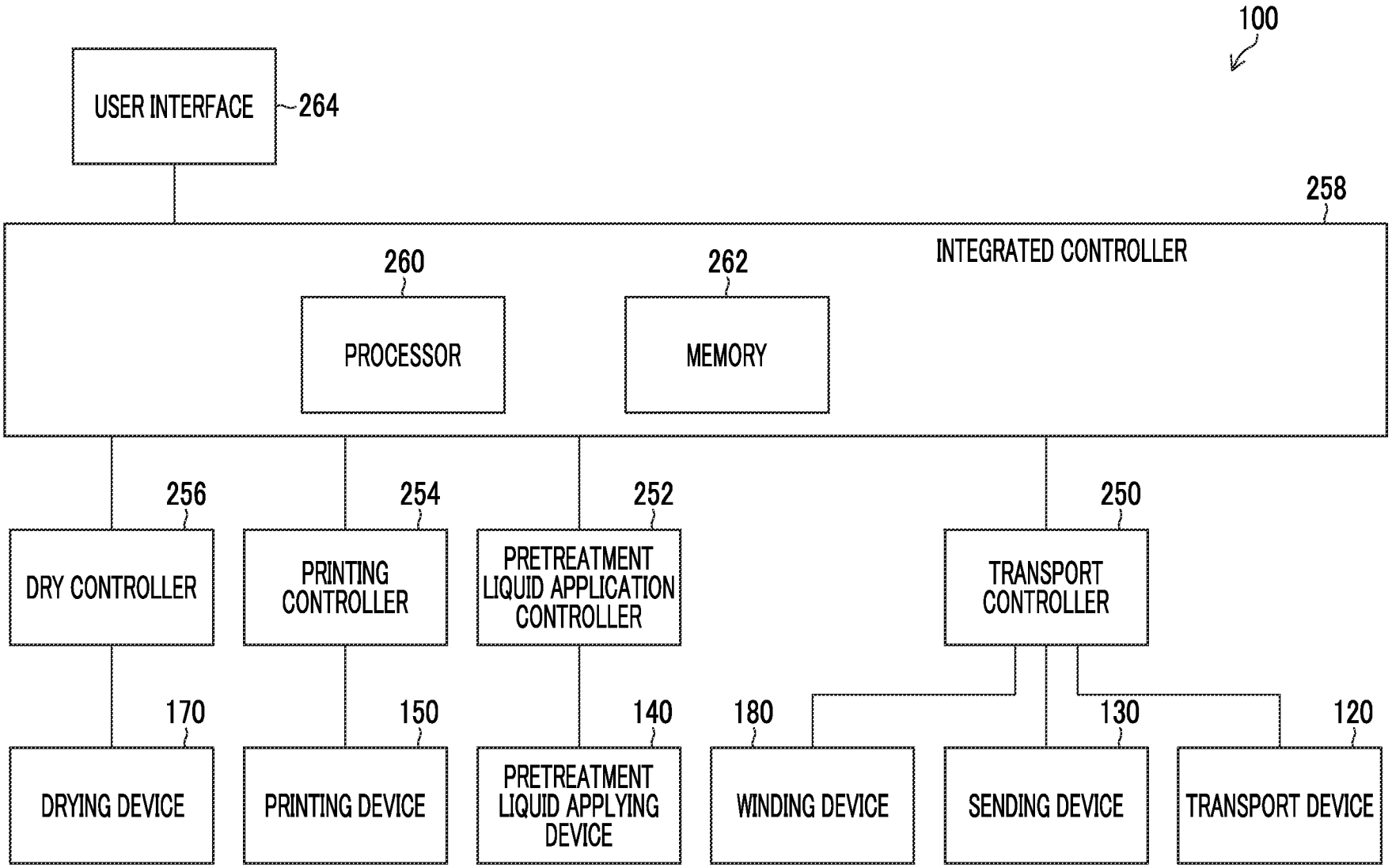
FIG. 7 is a functional block diagram showing an electric configuration of the ink jet printing device.

FIG. 7 is a functional block diagram showing an electric configuration of the ink jet printing device 100. As shown in FIG. 7, the ink jet printing device 100 comprises a transport controller 250, a pretreatment liquid application controller 252, a printing controller 254, a dry controller 256, an integrated controller 258, and a user interface 264.

The transport controller 250 controls the operations of the transport device 120, the sending device 130, and the winding device 180 based on a predetermined transport condition, and controls transporting of the paper 1 from the sending device 130 to the winding device 180. The transport condition includes a transport speed of the paper 1, a transport tension applied to the paper 1, a suction pressure of the printing drum 152, and a suction pressure of the drying drum 172.

The pretreatment liquid application controller 252 controls the operation of the pretreatment liquid applying device 140 based on a predetermined coating condition, and controls the application of the pretreatment liquid to the paper 1. The coating condition includes an application amount, a temperature control of the pretreatment liquid drying device 146, and a drying timing of the pretreatment liquid drying device 146.

The printing controller 254 controls the ink circulation of the ink jet heads 40K, 40C, 40M, 40Y, and 40W by controlling the operations of the ink circulation devices 10K, 10C, 10M, 10Y, and 10W in an integrated manner.

In addition, the printing controller 254 controls the jetting of the aqueous ink of each color of the ink jet heads 40K, 40C, 40M, 40Y, and 40W by applying a predetermined printing condition and printing data. The printing controller 254 may function as the state detector (see FIG. 3). In this case, the printing controller 254 determines a printing state in which the ink jet head 40 jets the ink and performs printing on the paper 1 as the jetting state, and a non-printing state in which the ink is not jetted as the non-jetting state.

The printing controller 254 comprises an image processing unit that generates half-tone data for each color from the printing data, such as raster data. The printing controller 254 comprises a drive voltage generation unit that generates the drive voltage supplied to the ink jet heads 40K, 40C, 40M, 40Y, and 40W based on the half-tone data for each color. The printing controller 254 comprises a drive voltage output unit that outputs the drive voltage supplied to the ink jet heads 40K, 40C, 40M, 40Y, and 40W.

The printing controller 254 performs correction processing of the ink jet heads 40K, 40C, 40M, 40Y, and 40W based on the imaging signal corresponding to the test image or the like transmitted from the scanner 154. The correction processing includes density correction, color correction, and correction processing of an abnormal nozzle.

The printing controller 254 comprises a maintenance controller that controls maintenance of the ink jet heads 40K, 40C, 40M, 40Y, and 40W. The maintenance of the ink jet heads 40K, 40C, 40M, 40Y, and 40W includes wiping the nozzle surface 200, purging for discharging the ink from the nozzle 202, and moisturizing the nozzle surface 200.

The dry controller 256 controls the operation of the drying device 170 based on a predetermined drying condition. That is, the drying condition includes a temperature of the hot air blown onto the paper 1 and an air volume.

The integrated controller 258 transmits a command signal to the transport controller 250, the pretreatment liquid application controller 252, the printing controller 254, and the dry controller 256, and controls the operation of the ink jet printing device 100 in an integrated manner.

The integrated controller 258 comprises a processor 260 and a memory 262. It should be noted that the integrated controller 258 may include the integrated controller 80 of the ink circulation device 10. In addition, the processor 260 may include the processor 80A. Further, the memory 262 may include the memory 80B.

The user interface 264 is used in a case in which a user operates the ink jet printing device 100. The user interface 264 includes an input device (not shown), such as a keyboard and a mouse. The user interface 264 includes a display device (not shown) that displays various pieces of information in the ink jet printing device 100.

Example

Figure 8:
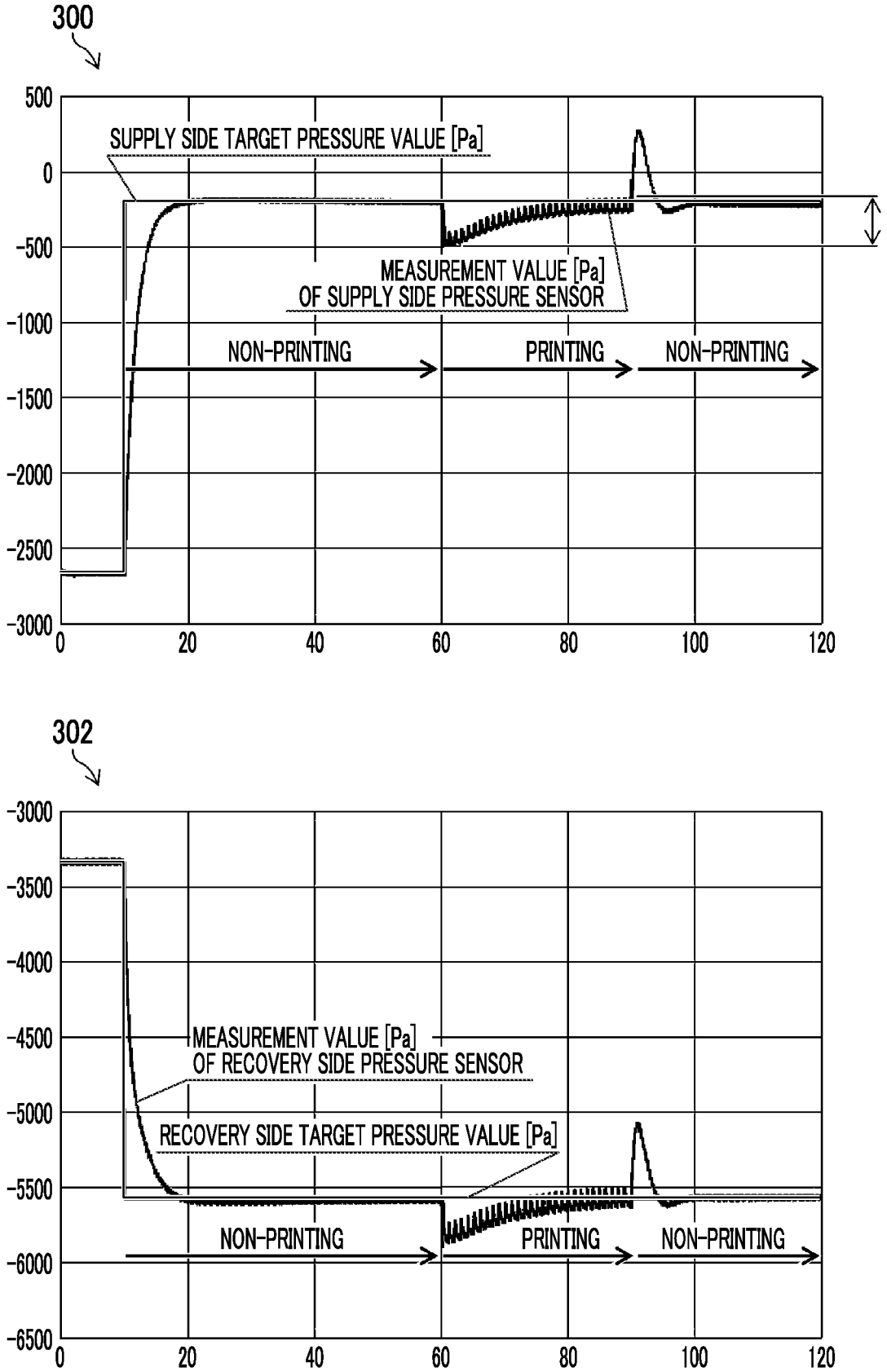
FIG. 8 is a graph showing a simulation result of an example.
Figure 9:
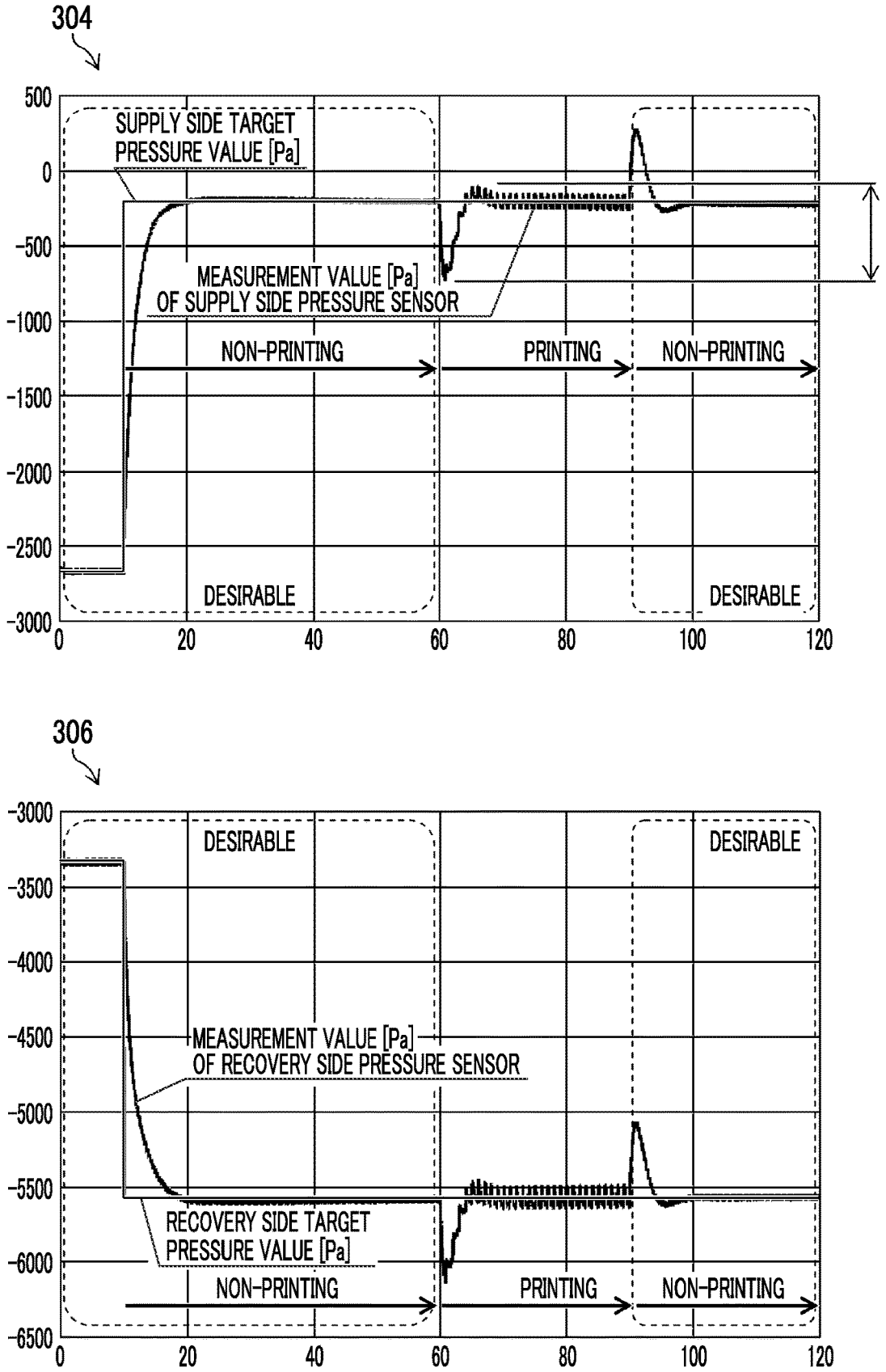
FIG. 9 is a graph showing a simulation result of a comparative example.
Figure 10:
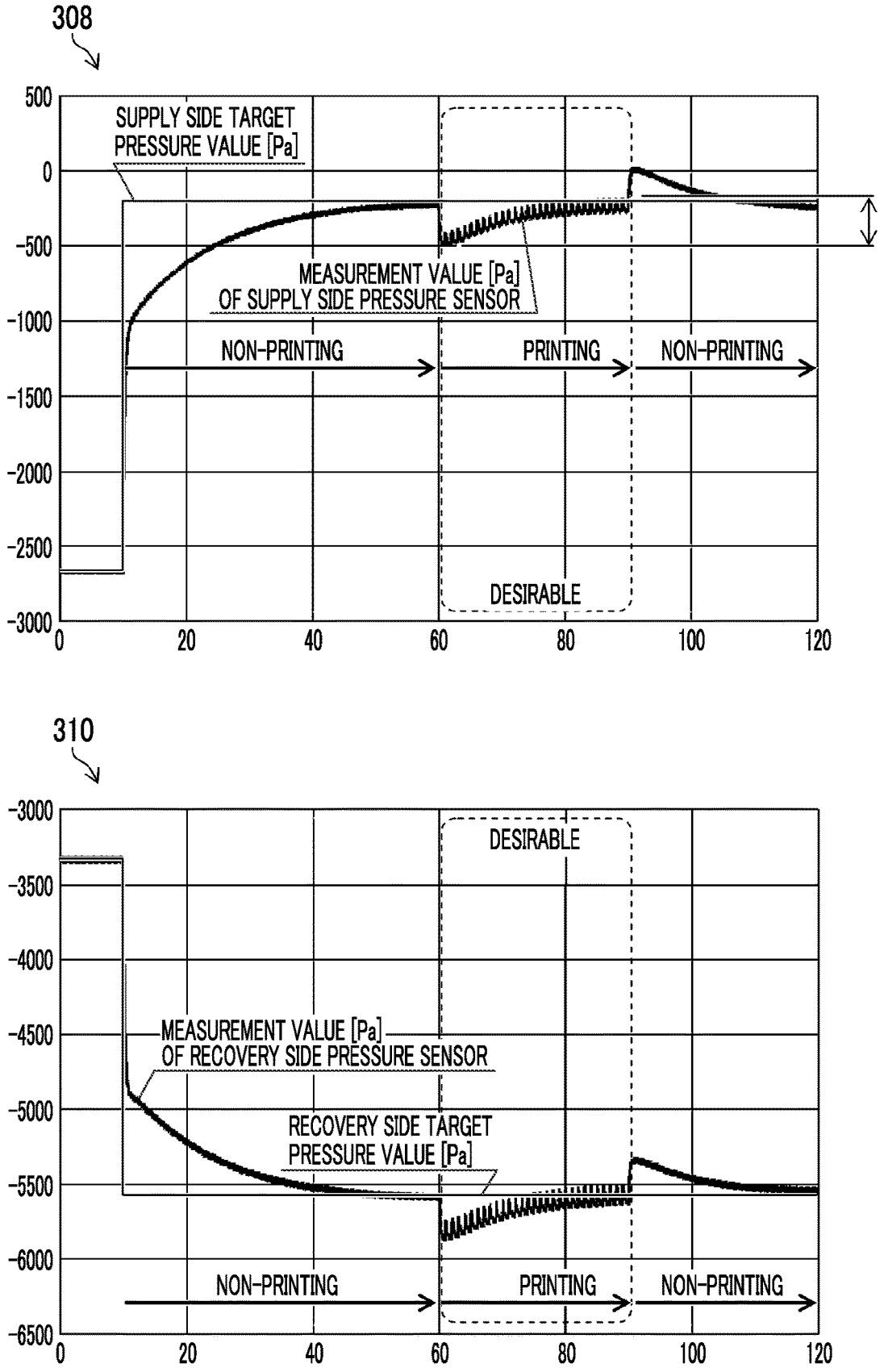
FIG. 10 is a graph showing the simulation result of the comparative example.

Simulation of the ink circulation control in the ink jet printing device 100 is performed. Here, a simulation result of the ink circulation device 10K will be described. FIG. 8 is a graph showing the simulation result of the example in which the parameters of the PID control are switched between the non-printing state and the printing state. In addition, FIGS. 9 and 10 are graphs showing the simulation results of a comparative example in which the parameters of the PID control are not switched in the non-printing state and the printing state, respectively.

300 shown in FIG. 8 shows the measurement value of the supply side pressure sensor 48 and the supply side target pressure value with respect to time, and 302 shown in FIG. 8 shows the measurement value of the recovery side pressure sensor 60 and the recovery side target pressure value with respect to time.

In the example shown in FIG. 8, an initial state is from a point of 0 seconds to a point of 10 seconds. In the initial state, the supply side target pressure value is −2700 [Pa], the recovery side target pressure value is −3300 [Pa], and the black aqueous ink does not circulate. In addition, the supply side target pressure value and the recovery side target pressure value are changed at the point of 10 seconds, and the ink circulation by the supply pump 32 and the recovery pump 36 is started. During the ink circulation, the supply side target pressure value is −200 [Pa], and the recovery side target pressure value is −5500 [Pa].

Here, the non-printing state is from the point of 10 seconds to a point of 60 seconds. That is, the paper 1 is not transported from the point of 10 seconds to the point of 60 seconds, and the ink jet head 40K is in the non-jetting state. In addition, the ink jet head 40K is in the printing state from the point of 60 seconds to a point of 90 seconds. That is, the paper 1 is transported from the point of 60 seconds to the point of 90 seconds, and the ink jet head 40K is in the jetting state. Further, from the point of 90 seconds to a point of 120 seconds, the ink jet head 40K is in the non-printing state again.

In the example shown in FIG. 8, the proportional gain Kp1_in, the integral gain Ki1_in, and the differential gain Kd1_in, which are the parameters of the PID control of the supply pump 32 in the non-printing state, have the following values, respectively.

$Kp1_in=0.3, Ki1_in=0.3, Kd1_in=1.00E-04$

The proportional gain Kp2_in, the integral gain Ki2_in, and the differential gain Kd2_in of the supply pump 32 in the printing state are the following values, respectively.

$$Kp2_in=1, Ki2_in=0.1, Kd2_in=1.00E\text{-}02$$

That is, the magnitude relationship of the parameters of the PID control of the supply pump 32 satisfies Expressions 11, 12, and 13.

In addition, the proportional gain Kp1_out, the integral gain Ki1_out, and the differential gain Kd1_out of the recovery pump 36 in the non-printing state have the following values, respectively.

$$Kp1_out=0.3, Ki1_out=0.3, Kd1_out=1.00E\text{-}04$$

The proportional gain Kp2_out, the integral gain Ki2_out, and the differential gain Kd2_out of the recovery pump 36 in the printing state are the following values, respectively.

$$Kp2_out=1, Ki2_out=0.1, Kd2_out=1.00E\text{-}02$$

That is, the magnitude relationship of the parameters of the PID control of the recovery pump 36 satisfies Expressions 16, 17, and 18.

Further, Expressions 19, 20, 21, 22, 23, and 24 are satisfied here.

$$Kp1_in=Kp1_out \quad \text{(Expression 19)}$$

$$Ki1_in=Ki1_out \quad \text{(Expression 20)}$$

$$Kd1_in=Kd1_out \quad \text{(Expression 21)}$$

$$Kp2_in=Kp2_out \quad \text{(Expression 22)}$$

$$Ki2_in=Ki2_out \quad \text{(Expression 23)}$$

$$Kd2_in=Kd2_out \quad \text{(Expression 24)}$$

304 shown in FIG. 9 shows the measurement value of the supply side pressure sensor 48 and the supply side target pressure value with respect to time, and 306 shown in FIG. 9 shows the measurement value of the recovery side pressure sensor 60 and the recovery side target pressure value with respect to time. The target pressure value in FIG. 9 and a control timing are the same as those in FIG. 8.

In the comparative example shown in FIG. 9, the proportional gain Kp_in, the integral gain Ki_in, and the differential gain Kd_in of the supply pump 32 have the following values regardless of the non-printing state and the printing state.

$$Kp_in=0.3, Ki_in=0.3, Kd_in=1.00E\text{-}04$$

308 shown in FIG. 10 shows the measurement value of the supply side pressure sensor 48 and the supply side target pressure value with respect to time, and 310 shown in FIG. 10 shows the measurement value of the recovery side pressure sensor 60 and the recovery side target pressure value with respect to time. The target pressure value in FIG. 10 and the control timing are the same as those in FIG. 8.

In the comparative example shown in FIG. 10, the proportional gain Kp_in, the integral gain Ki_in, and the differential gain Kd_in of the supply pump 32 have the following values regardless of the non-printing state and the printing state.

$$Kp_in=1, Ki_in=0.1, Kd_in=1.00E\text{-}02$$

Comparing FIG. 8 and FIG. 10, a time from the point of 10 seconds at which the circulation is started until a measurement pressure value reaches the target pressure value is about 10 seconds on both the supply side and the recovery side in the example shown in FIG. 8, but is about 50 seconds in the comparative example shown in FIG. 10, so that it can be seen that the time is shorter in the example. In addition, a time from the point of 90 seconds at which the printing state is switched to the non-printing state until the measurement pressure value returns to the target pressure value is about 10 seconds on both the supply side and the recovery side in the example, but is equal to or longer than 30 seconds in the comparative example, so that it can be seen that time is shorter in the example.

In addition, comparing FIGS. 8 and 9, the pressure fluctuation in the printing state from the point of 60 seconds to the point of 90 seconds is about 300 [Pa] on both the supply side and the recovery side in the example shown in FIG. 8, but is 600 [Pa] or more in the comparative example shown in FIG. 9, so that it can be seen that the pressure fluctuation is smaller in the example than in the comparative example.

As described above, it can be seen that, by setting the parameters of the PID control satisfying Expressions 11 to 13 and 16 to 19, the time from the start of circulation until the measurement pressure value reaches the target pressure value and the time from switching from the printing state to the non-printing state until the measurement pressure value reaches the target pressure value can be relatively shortened, and the pressure fluctuation in the printing state can be relatively reduced.

Change of Target Pressure Value

FIGS. 11 to 14 are graphs showing the simulation results in a case in which the target pressure value of the ink circulation device 10K is changed.

Figure 11:
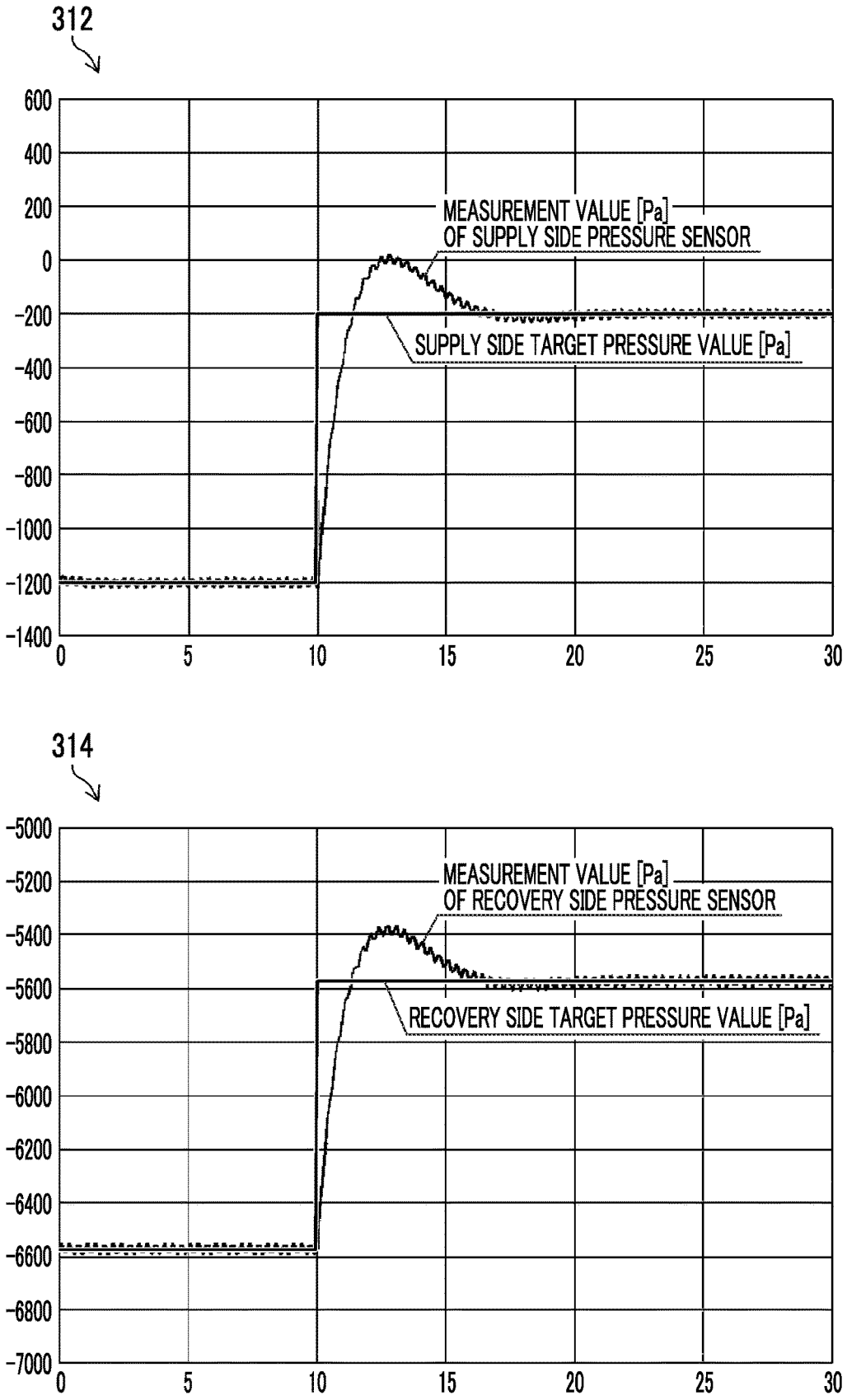
FIG. 11 is a graph showing a simulation result in a case in which a target pressure value of the ink circulation device is changed.

312 shown in FIG. 11 shows the measurement value of the supply side pressure sensor 48 and the supply side target pressure value with respect to time, and 314 shown in FIG. 11 shows the measurement value of the recovery side pressure sensor 60 and the recovery side target pressure value with respect to time.

In the example shown in FIG. 11, the initial state is from the point of 0 seconds to the point of 10 seconds. In the initial state, the supply side target pressure value is −1200 [Pa], the recovery side target pressure value is −6600 [Pa], and the black aqueous ink does not circulate. In addition, the supply side target pressure value and the recovery side target pressure value are changed at the point of 10 seconds, and the ink circulation by the supply pump 32 and the recovery pump 36 is started. During the ink circulation, the supply side target pressure value is −200 [Pa], and the recovery side target pressure value is −5600 [Pa]. As described above, in the example shown in FIG. 11, both the supply side target pressure value and the recovery side target pressure value are changed in a positive direction at the start of the ink circulation. That is, the target pressure value is changed in the same direction on the supply side and the circulation side.

In addition, in the example shown in FIG. 11, the proportional gain Kp_in, the integral gain Ki_in, the differential gain Kd_in of the supply pump 32, and the proportional gain Kp_out, the integral gain Ki_out, and the differential gain Kd_out of the recovery pump 36 are the following values, respectively.

$$Kp_in=Kp_out=0.3, Ki_in=Ki_out=0.3, Kd_in=Kd_out=1.00E\text{-}04$$

Figure 12:
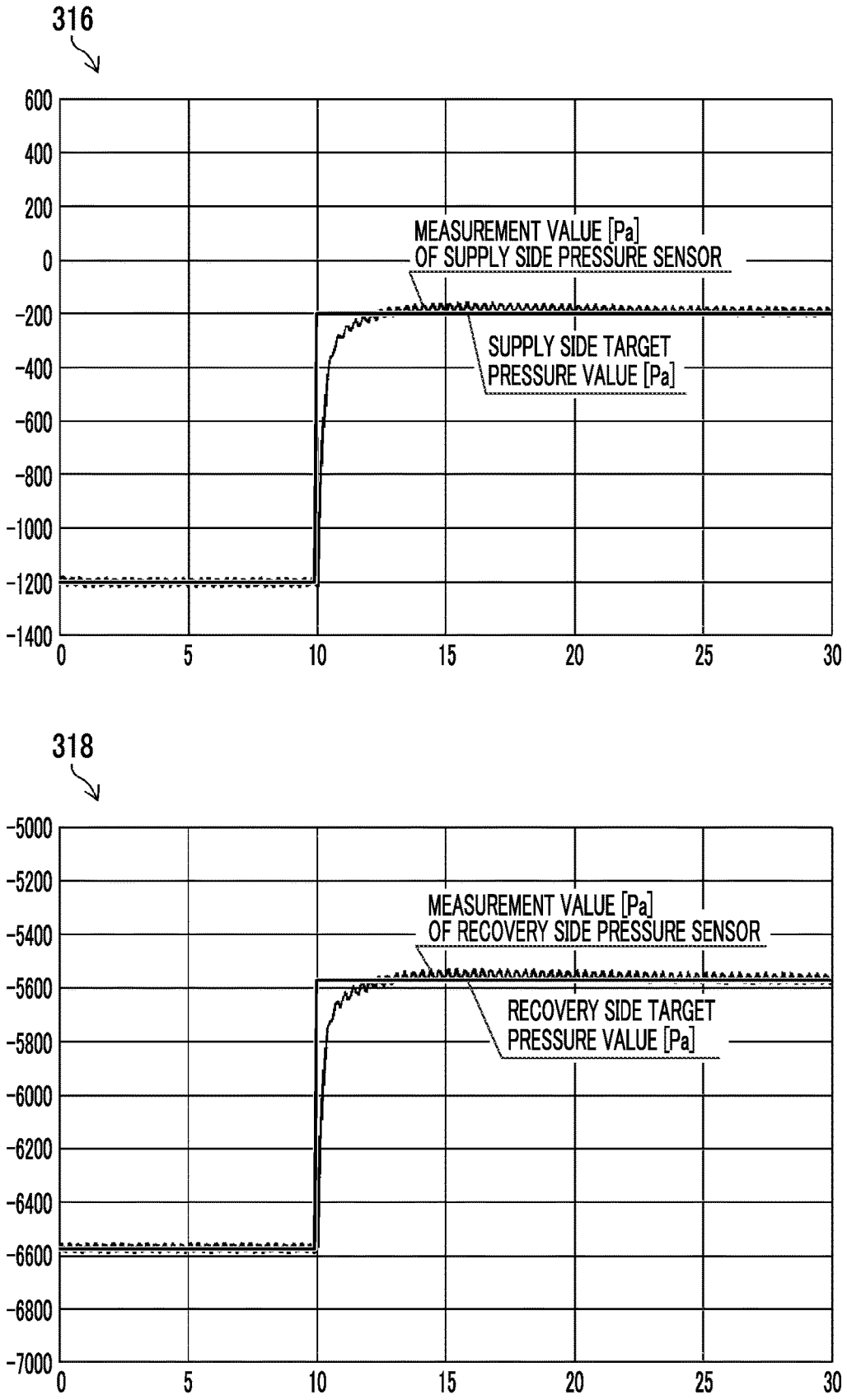
FIG. 12 is a graph showing the simulation result in a case in which the target pressure value of the ink circulation device is changed.

On the other hand, 316 shown in FIG. 12 shows the measurement value of the supply side pressure sensor 48 and the supply side target pressure value with respect to time, and 318 shown in FIG. 12 shows the measurement value of the recovery side pressure sensor 60 and the recovery side target pressure value with respect to time. The target pressure value in FIG. 12 and the control timing are the same as those in FIG. 11.

In the example shown in FIG. 12, the proportional gain Kp1_in, the integral gain Ki1_in, the differential gain Kd1_in, the proportional gain Kp_out, the integral gain Ki_out, and the differential gain Kd_out, which are the parameters of the PID control of the supply pump 32, of the recovery pump 36 have the following values, respectively.

$$Kp_in=Kp_out=1, Ki_in=Ki_out=0.1, Kd_in=Kd_out=1.00E\text{-}02$$

Comparing FIGS. 11 and 12, a time from the point of 10 seconds at which the target pressure value is changed until the measurement pressure value reaches the target pressure value is about 7 seconds on both the supply side and the recovery side in the example shown in FIG. 11, but is about 2 seconds in the example shown in FIG. 12, so that it can be seen that the time is shorter in the example shown in FIG. 12. In addition, the pressure fluctuation from the point of 10 seconds until the measurement pressure value reaches the target pressure value has an overshoot of about 200 [Pa] on both the supply side and the recovery side in the example shown in FIG. 11, but has no overshoot in the example shown in FIG. 12, so that it can be seen that the pressure fluctuation is smaller in the example in FIG. 12.

Figure 13:
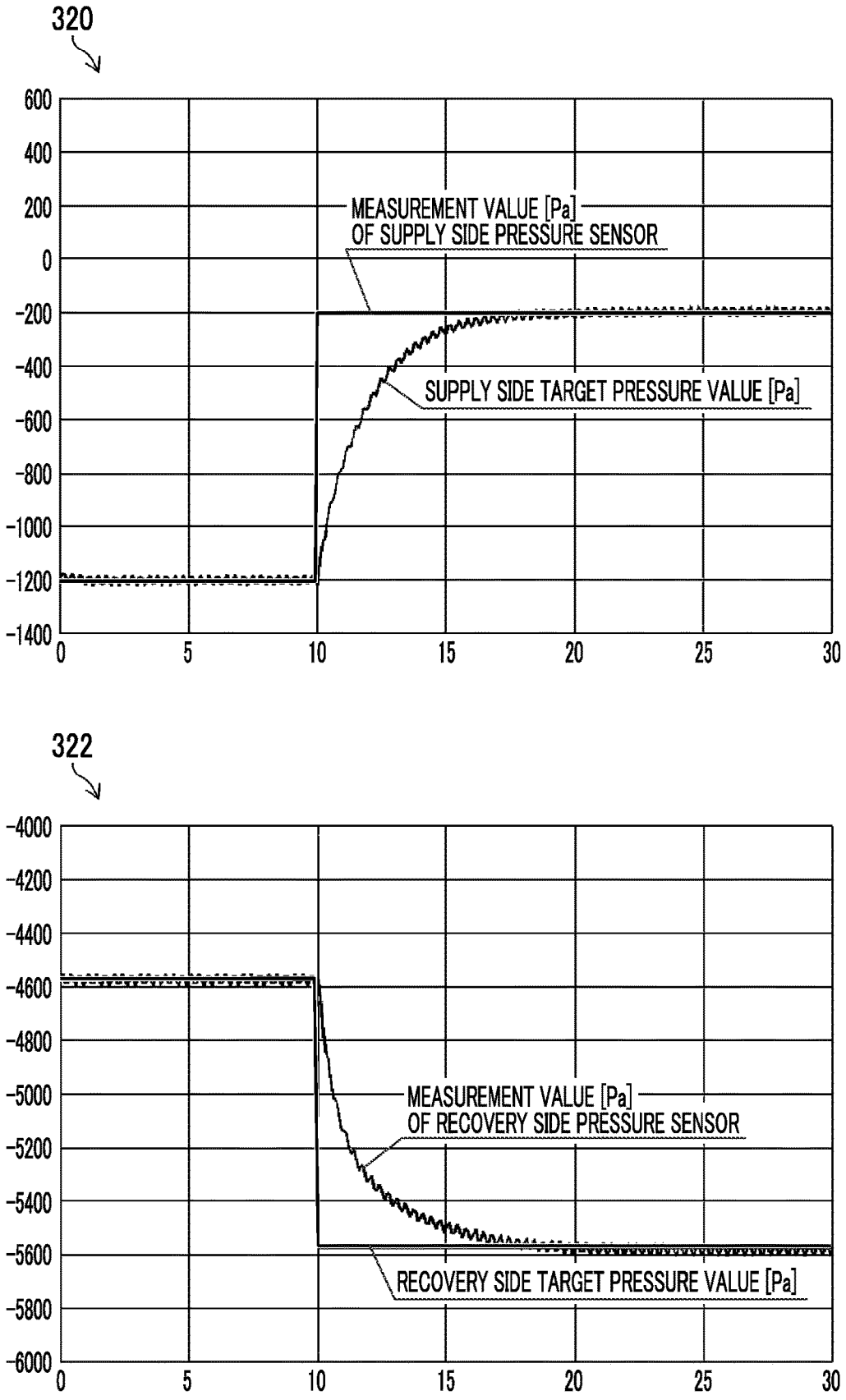
FIG. 13 is a graph showing the simulation result in a case in which the target pressure value of the ink circulation device is changed.

Next, 320 shown in FIG. 13 shows the measurement value of the supply side pressure sensor 48 and the supply side target pressure value with respect to time, and 322 shown in FIG. 13 shows the measurement value of the recovery side pressure sensor 60 and the recovery side target pressure value with respect to time.

In the example shown in FIG. 13, the initial state is from the point of 0 seconds to the point of 10 seconds. In the initial state, the supply side target pressure value is −1200 [Pa], the recovery side target pressure value is −4500 [Pa], and the black aqueous ink does not circulate. In addition, the supply side target pressure value and the recovery side target pressure value are changed at the point of 10 seconds, and the ink circulation by the supply pump 32 and the recovery pump 36 is started. During the ink circulation, the supply side target pressure value is −200 [Pa], and the recovery side target pressure value is −5600 [Pa]. As described above, in the example shown in FIG. 13, the supply side target pressure value is changed in the positive direction and the target pressure value on the circulation side is changed in a negative direction at the start of the ink circulation. That is, the target pressure value is changed in the opposite direction on the supply side and the circulation side.

In the example shown in FIG. 13, the proportional gain Kp_in, the integral gain Ki_in, the differential gain Kd_in of the supply pump 32, and the proportional gain Kp_out, the integral gain Ki_out, and the differential gain Kd_out of the recovery pump 36 are the following values, respectively.

$$Kp_in=Kp_out=0.3, Ki_in=Ki_out=0.3, Kd_in=Kd_out=1.00E\text{-}04$$

Figure 14:
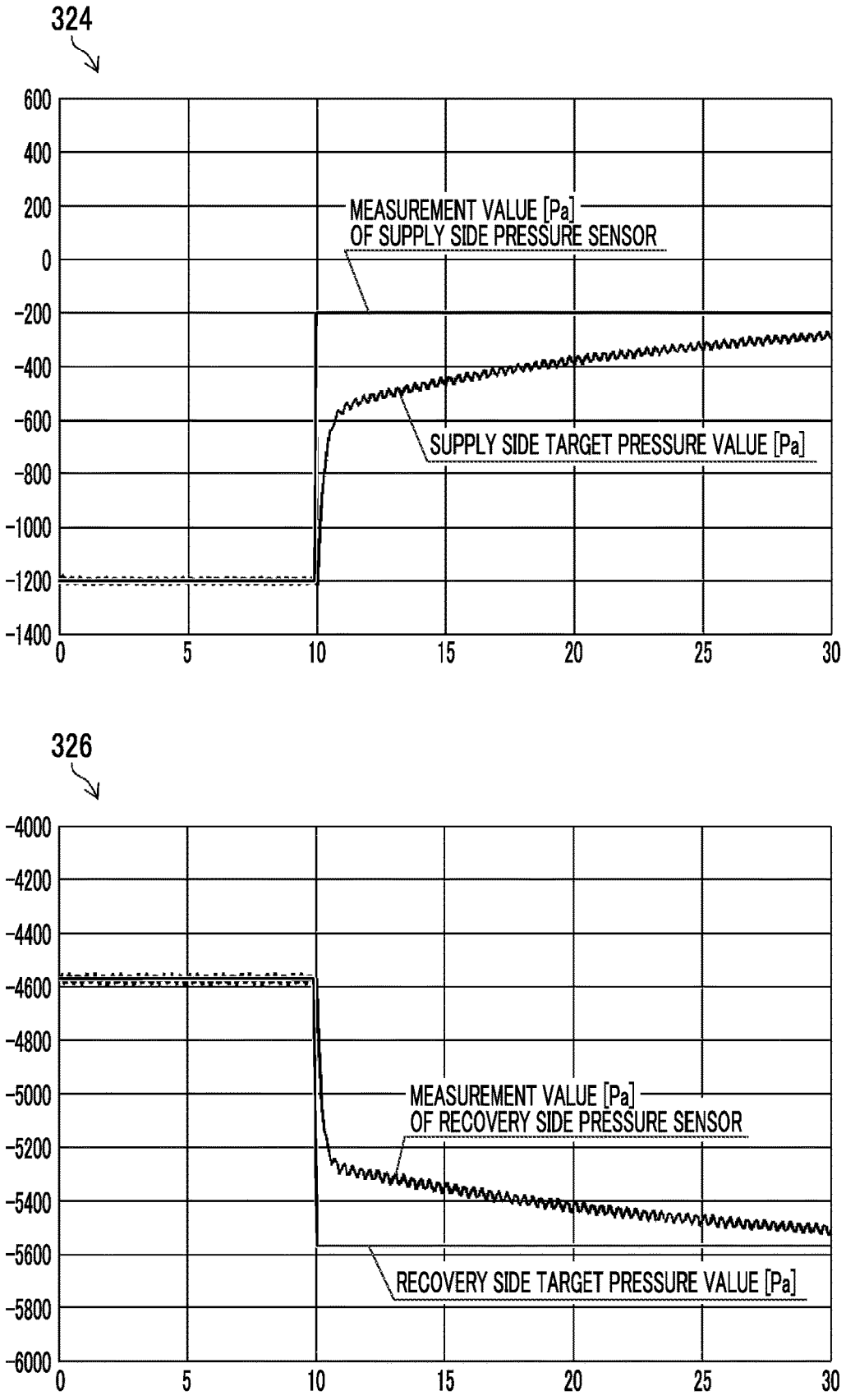
FIG. 14 is a graph showing the simulation result in a case in which the target pressure value of the ink circulation device is changed.

On the other hand, 324 shown in FIG. 14 shows the measurement value of the supply side pressure sensor 48 and the supply side target pressure value with respect to time, and 326 shown in FIG. 14 shows the measurement value of the recovery side pressure sensor 60 and the recovery side target pressure value with respect to time. The target pressure value in FIG. 14 and the control timing of pressure are the same as those in FIG. 13.

In the example shown in FIG. 14, the proportional gain Kp1_in, the integral gain Ki1_in, the differential gain Kd1_in, the proportional gain Kp_out, the integral gain Ki_out, and the differential gain Kd_out, which are the parameters of the PID control of the supply pump 32, of the recovery pump 36 have the following values, respectively.

$$Kp_in=Kp_out=1, Ki_in=Ki_out=0.1, Kd_in=Kd_out=1.00E\text{-}02$$

Comparing FIGS. 13 and 14, a time from the point of 10 seconds at which the target pressure value is changed until the measurement pressure value reaches the target pressure value is 7 to 8 seconds on both the supply side and the recovery side in the example shown in FIG. 13, but is equal to or longer than 20 seconds in the example shown in FIG. 14, so that it can be seen that the time is shorter in the example shown in FIG. 13.

Continuous Control

Instead of simply changing the parameters of the PID control under the two conditions of the jetting state (printing state) and the non-jetting state (non-printing state), the parameters of the PID control may be continuously changed with respect to the jetting amount of the ink jet head 40 in the jetting state.

In a case in which the flow rate of the ink in the supply flow passage 22 is denoted by Qin and the flow rate of the ink in the recovery flow passage 24 is denoted by Qout, the jetting amount Qjet of the ink jet head 40 can be represented by Expression 25.

$$Qjet=Qin-Qout \quad \text{(Expression 25)}$$

In a case in which the reference proportional gain of the supply pump 32 in the jetting state is denoted by Kp0_in, the factor of proportionality of the proportional gain is denoted by Ap_in, the reference integral gain is denoted by Ki0_in, the factor of proportionality of the integral gain is denoted by Ai_in, the reference differential gain is denoted by Kd0_in, and the factor of proportionality of the differential gain is denoted by Ad_in, the proportional gain Kp2_out of the supply pump 32 in the jetting state, the integral gain Ki2_out, and the differential gain Kd2_out have relationships of Expressions 26, 27, and 28, respectively.

$$Kp2_in=Kp0_in+Ap_in\times Qjet \quad \text{(Expression 26)}$$

$$Ki2_in=Ki0_in-Ai_in\times Qjet \quad \text{(Expression 27)}$$

$$Kd2_in=Kd0_in+Ad_in\times Qjet \quad \text{(Expression 28)}$$

Similarly, in a case in which the reference proportional gain of the recovery pump 36 in the jetting state is denoted by Kp0_out, the factor of proportionality of the proportional gain is denoted by Ap_out, the reference integral gain is denoted by Ki0_out, the factor of proportionality of the integral gain is denoted by Ai_out, the reference differential gain is denoted by Kd0_out, and the factor of proportionality of the differential gain is denoted by Ad_out, the proportional gain Kp2_out of the recovery pump 36 in the jetting state, the integral gain Ki2_out, and the differential gain Kd2_out have relationships of Expressions 29, 30, and 31, respectively.

$$Kp2_out=Kp0_out+Ap_out\times Qjet \quad \text{(Expression 29)}$$

$$Ki2_out=Ki0_out-Ai_out\times Qjet \quad \text{(Expression 30)}$$

$$Kd2_out=Kd0_out+Ad_out\times Qjet \quad \text{(Expression 31)}$$

It should be noted that it is preferable that the parameters of the PID control determined by Expressions 26, 27, and 28 satisfy Expressions 11, 12, and 13, and the parameters of the PID control determined by Expressions 29, 30, and 31 satisfy Expressions 16, 17, and 18.

As described above, by setting the parameters of the PID control satisfying Expressions 26 to 28 and Expressions 29 to 31, it is possible to continuously suppress the high-frequency pressure fluctuation of the ink in the jetting state.

Others

A program that realizes the function of the control method of the ink circulation device 10 can be configured on the computer. In addition, the program can be stored in a computer-readable information storage medium, which is a tangible non-transitory information storage medium, and the program can be provided via the information storage medium.

The technical scope of the present invention is not limited to the range described in the embodiment described above. The configurations and the like in each embodiment can be appropriately combined between the respective embodiments without departing from the spirit of the present invention.

EXPLANATION OF REFERENCES

1: paper
10: ink circulation device
10C: ink circulation device
10K: ink circulation device
10M: ink circulation device
10Y: ink circulation device
20: ink tank
20A: supply port
20B: recovery port
22: supply flow passage
24: recovery flow passage
26I: joint
26O: joint
28: joint
30: degassing module
32: supply pump
36: recovery pump
39: one-way valve
40: ink jet head
40C: ink jet head
40K: ink jet head
40M: ink jet head
40Y: ink jet head
42: head module
42A: ink supply port
42B: ink recovery port
44: supply side back pressure tank
44A: ink inlet
44B: ink outlet
44C: liquid chamber
44D: air chamber
44E: elastic membrane
46: supply side head manifold
48: supply side pressure sensor
50: ink supply flow passage
52: supply valve
54: supply damper
56: ink recovery flow passage
58: recovery side head manifold
60: recovery side pressure sensor
62: recovery damper
64: recovery valve
66: recovery side back pressure tank
68: first bypass flow passage
70: second bypass flow passage
72: first bypass flow passage valve
74: second bypass flow passage valve
80: integrated controller
80A: processor
80B: memory
100: ink jet printing device
120: transport device
122: pass roller
130: sending device
132: roll
140: pretreatment liquid applying device
142: applying roller
144: facing roller
146: pretreatment liquid drying device
150: printing device
152: printing drum
154: scanner
170: drying device
172: drying drum
180: winding device
182: roll
200: nozzle surface
202: nozzle
204: pressure chamber
210: supply tributary
212: common flow passage
216: ink circulation passage
218: recovery tributary
220: circulation common flow passage
226: vibration plate
228: actuator
230: nozzle plate
232: flow passage plate
250: transport controller
252: pretreatment liquid application controller
254: printing controller
256: dry controller
258: integrated controller
260: processor
262: memory
264: user interface

What is claimed is:

1. A control device of an ink circulation device including an upstream side flow passage that circulates an ink from an ink tank that stores the ink to an ink jet head that jets the ink, an upstream side pump that is provided in the upstream side flow passage and supplies the ink stored in the ink tank to the ink jet head, an upstream side pressure sensor that measures a pressure in the upstream side flow passage, a downstream side flow passage that circulates the ink from the ink tank to the ink jet head, a downstream side pump that is provided in the downstream side flow passage and recovers the ink supplied to the ink jet head into the ink tank, and a downstream side pressure sensor that measures a pressure in the downstream side flow passage, the control device comprising:

at least one processor; and at least one memory that stores a command to be executed by the at least one processor, wherein the at least one processor circulates the ink to the ink jet head by applying a pressure difference between an upstream side and a downstream side of the ink jet head by the upstream side pump and the downstream side pump, performs a proportional-integral-differential (PID) control on the upstream side pump and the downstream side pump such that each of a measurement value of the upstream side pressure sensor and a measurement value of the downstream side pressure sensor becomes a target value, and switches parameters of the PID control between a jetting state in which the ink is jetted from the ink jet head and a non-jetting state different from the jetting state, in a case in which, in the upstream side pump in the non-jetting state, proportional gain is denoted by Kp1_in, integral gain is denoted by Ki1_in, and differential gain is denoted by Kd1_in, and, in the upstream side pump in the jetting state, proportional gain is denoted by Kp2_in, integral gain is denoted by Ki2_in, and differential gain is denoted by Kd2_in, the parameters of the PID control have relationships of Kp1_in<Kp2_in, Ki1_in>Ki2_in, and Kd1_in<Kd2_in, and in a case in which, in the downstream side pump in the non-jetting state, proportional gain is denoted by Kp1_out, integral gain is denoted by Ki1_out, and differential gain is denoted by Kd1_out, and, in the downstream side pump in the jetting state, proportional gain is denoted by Kp2_out, integral gain is denoted by Ki2_out, and differential gain is denoted by Kd2_out, the parameters of the PID control have relationships of Kp1_out<Kp2_out, Ki1_out>Ki2_out, and Kd1_out<Kd2_out.

2. The control device of an ink circulation device according to claim 1, wherein the at least one processor acquires a first difference between a flow rate of the ink in the upstream side flow passage and a flow rate of the ink in the downstream side flow passage, determines a case in which the first difference is larger than a predetermined threshold value as the jetting state, and determines a case in which the first difference is equal to or smaller than the threshold value as the non-jetting state.

3. The control device of an ink circulation device according to claim 2, wherein the at least one processor acquires a jetting amount of the ink jet head from the first difference, and continuously changes the parameters of the PID control with respect to the acquired jetting amount.

4. The control device of an ink circulation device according to claim 3, wherein, in a case in which the jetting amount is denoted by Qjet, reference proportional gain of the upstream side pump in the jetting state is denoted by Kp0_in, factor of proportionality of the proportional gain of the upstream side pump in the jetting state is denoted by Ap_in, reference integral gain of the upstream side pump in the jetting state is denoted by Ki0_in, factor of proportionality of the integral gain of the upstream side pump in the jetting state is denoted by Ai_in, reference differential gain of the upstream side pump in the jetting state is denoted by Kd0_in, and factor of proportionality of the differential gain of the upstream side pump in the jetting state is denoted by Ad_in, the parameters of the PID control have relationships of Kp2_in=Kp0_in+Ap_in×Qjet, Ki2_in=Ki0_in−Ai_in×Qjet, and Kd2_in=Kd0_in+Ad_in×Qjet, and in a case in which, in the downstream side pump in the jetting state, reference proportional gain is denoted by Kp0_out, factor of proportionality of the proportional gain is denoted by Ap_out, reference integral gain is denoted by Ki0_out, factor of proportionality of the integral gain is denoted by Ai_out, reference differential gain is denoted by Kd0_out, and factor of proportionality of the differential gain is denoted by Ad_out, the parameters of the PID control have relationships of Kp2_out=Kp0_out+Ap_out×Qjet, Ki2_out=Ki0_out−Ai_out×Qjet, and Kd2_out=Kd0_out+Ad_out×Qjet.

5. The control device of an ink circulation device according to claim 2, wherein the at least one processor acquires the first difference of the upstream side flow passage from a speed of the upstream side pump and a speed of the downstream side pump.

6. The control device of an ink circulation device according to claim 2, wherein the ink circulation device further includes an upstream side flowmeter that measures the flow rate of the ink in the upstream side flow passage, and a downstream side flowmeter that measures the flow rate of the ink in the downstream side flow passage, and the at least one processor acquires the first difference from a measurement value of the upstream side flowmeter and a measurement value of the downstream side flowmeter.

7. The control device of an ink circulation device according to claim 1, wherein the parameters of the PID control have relationships of Kp1_in=Kp1_out, Ki1_in=Ki1_out, Kd1_in=Kd1_out, Kp2_in=Kp2_out, Ki2_in=Ki2_out, and Kd2_in=Kd2_out.

8. A printing device comprising:

an ink circulation device including an upstream side flow passage that circulates an ink from an ink tank that stores the ink to an ink jet head that jets the ink, an upstream side pump that is provided in the upstream side flow passage and supplies the ink stored in the ink tank to the ink jet head, an upstream side pressure sensor that measures a pressure in the upstream side flow passage, a downstream side flow passage that circulates the ink from the ink tank to the ink jet head, a downstream side pump that is provided in the downstream side flow passage and recovers the ink supplied to the ink jet head into the ink tank, and a downstream side pressure sensor that measures a pressure in the downstream side flow passage;

the control device of an ink circulation device according to claim 1;

the ink tank that stores the ink;

the ink jet head that jets the ink; and a moving mechanism that relatively moves a recording medium and the ink jet head, wherein the at least one processor jets the ink from the ink jet head to perform printing on the recording medium.

9. The printing device according to claim 8, wherein the at least one processor determines a case in which the printing is performed as the jetting state, and determines a case in which the printing is not performed as the non-jetting state.

10. A control method of an ink circulation device including an upstream side flow passage that circulates an ink from an ink tank that stores the ink to an ink jet head that jets the ink, a downstream side flow passage that circulates the ink from the ink tank to the ink jet head, a pump that is provided in the upstream side flow passage or the downstream side flow passage, supplies the ink from the ink tank to the ink jet head through the upstream side flow passage, and recovers the ink supplied to the ink jet head into the ink tank through the downstream side flow passage, and a pressure sensor that measures a pressure in the upstream side flow passage or the downstream side flow passage, the control method comprising:

a circulation step of circulating the ink to the ink jet head by applying a pressure difference between an upstream side and a downstream side of the ink jet head by the pump;

a proportional-integral-differential (PID) control step of performing a PID control on the pump such that a measurement value of pressure sensor becomes a target value; and a switch step of switching parameters of the PID control between a jetting state in which the ink is jetted from the ink jet head and a non-jetting state different from the jetting state, wherein, in a case in which, in the pump in the non-jetting state, proportional gain is denoted by Kp1, integral gain is denoted by Ki1, and differential gain is denoted by Kd1, and, in the pump in the jetting state proportional gain is denoted by Kp2, integral gain is denoted by Ki2, and differential gain is denoted by Kd2, the parameters of the PID control have relationships of $Kp1<Kp2$, $Ki1>Ki2$, and $Kd1<Kd2$.

11. A non-transitory, computer-readable tangible storage medium which records thereon a program causing, when read by a computer, the computer to execute the control method of an ink circulation device according to claim 10.

* * * * *